US010428477B2

(12) United States Patent
Hiller et al.

(10) Patent No.: US 10,428,477 B2
(45) Date of Patent: Oct. 1, 2019

(54) CHUTE CONTROL ASSEMBLY FOR A SNOW THROWER

(71) Applicant: MTD PRODUCTS INC., Valley City, OH (US)

(72) Inventors: Adam Hiller, Jeromesville, OH (US); Michael Wright, Wadsworth, OH (US); Keith Fortlage, Medina, OH (US); Alan Dumitrescu, West Salem, OH (US)

(73) Assignee: MTD PRODUCTS INC, Valley City, OH (US)

( * ) Notice: Subject to any disclaimer, the term of this patent is extended or adjusted under 35 U.S.C. 154(b) by 14 days.

(21) Appl. No.: 15/672,493

(22) Filed: Aug. 9, 2017

(65) Prior Publication Data

US 2019/0048544 A1 Feb. 14, 2019

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/045; E01H 5/098
See application file for complete search history.

(56) References Cited

U.S. PATENT DOCUMENTS 3,078,603 A 2/1963 Ertsgaard et al.
3,509,977 A 5/1970 Bacon
3,867,773 A 2/1975 Gunderson
3,879,866 A 4/1975 Gunderson
4,011,668 A 3/1977 Gunderson
4,068,397 A 1/1978 Bacon
4,072,359 A 2/1978 Lillkvist
4,205,468 A 6/1980 Greider
4,255,881 A 3/1981 Fralish
4,409,748 A 10/1983 Westimayer
4,694,594 A * 9/1987 Thorud ..... E01H 5/098 37/233
4,862,607 A 9/1989 Wacker
5,177,888 A * 1/1993 Thorud ..... A01D 43/087 193/16
5,444,927 A * 8/1995 Sosenko ..... E01H 5/045 37/244

(Continued)

FOREIGN PATENT DOCUMENTS

EP 1964977 9/2008
EP 2484835 8/2012

(Continued)

*Primary Examiner* — Jamie L McGowan
(74) *Attorney, Agent, or Firm* — Wegman, Hessler

(57) ABSTRACT

A chute control assembly for a snow thrower having a housing, handle, and a chute includes a control mechanism, a connecting mechanism, and a guide mechanism. The control mechanism includes an actuator mechanism that allows an operator to manually control the orientation of the chute from a position spaced apart from the chute. The connecting mechanism transfers rotation of the actuator mechanism to the guide mechanism. The guide mechanism is attached to the chute and rotates and adjust the orientation of the chute in response to rotation of the actuator mechanism in order to change the direction that snow is thrown from the snow thrower.

8 Claims, 19 Drawing Sheets

(56) References Cited

U.S. PATENT DOCUMENTS

| | | | | |
|---|---|---|---|---|
| 5,735,064 | A | 4/1998 | Holl | |
| 6,499,238 | B2 | 12/2002 | Kluck et al. | |
| 6,502,335 | B2 * | 1/2003 | Prochnow | F16C 1/10 37/244 |
| 7,032,333 | B2 | 4/2006 | Friberg et al. | |
| 7,093,380 | B2 * | 8/2006 | Hubscher | E01H 5/06 172/679 |
| 7,165,345 | B2 | 1/2007 | Beaudoin | |
| 7,194,827 | B2 | 3/2007 | Mercer et al. | |
| 7,347,013 | B2 | 3/2008 | Deschler et al. | |
| 7,472,500 | B2 | 1/2009 | White, III | |
| 7,624,521 | B2 | 12/2009 | White, III et al. | |
| 7,703,223 | B2 * | 4/2010 | Walker | E01H 5/045 37/244 |
| 7,735,246 | B2 | 6/2010 | Kaskawitz | |
| 8,016,098 | B2 * | 9/2011 | Saiia | E01H 5/045 198/640 |
| 8,938,894 | B2 * | 1/2015 | Raasch | E01H 5/045 37/261 |
| 9,096,981 | B2 | 8/2015 | Wians et al. | |
| 9,290,897 | B2 * | 3/2016 | Schisel | E01H 5/098 |
| 9,340,938 | B2 | 5/2016 | Ferrell et al. | |
| 9,399,846 | B2 | 7/2016 | Friberg | |
| 2003/0226738 | A1 | 12/2003 | Eakins et al. | |
| 2006/0070265 | A1 | 4/2006 | Cohen | |
| 2006/0225309 | A1 | 10/2006 | Champagne et al. | |
| 2008/0209771 | A1 | 9/2008 | Jerger et al. | |
| 2009/0205226 | A1 | 8/2009 | Olmr et al. | |
| 2014/0157633 | A1 * | 6/2014 | Hansen | E01H 5/09 37/260 |

FOREIGN PATENT DOCUMENTS

| | | |
|---|---|---|
| EP | 2721221 | 4/2014 |
| WO | 2012/177234 | 12/2012 |

* cited by examiner

CHUTE CONTROL ASSEMBLY FOR A SNOW THROWER

FIELD OF THE INVENTION

The present invention is directed to snow clearing devices, and more particularly, to an assembly for adjusting the chute that expels snow on a snow thrower.

BACKGROUND OF THE INVENTION

Snow throwers are configured to remove accumulated snow from sidewalks, driveways, and other surfaces. Snow throwers typically use a variety of rotating augers, brushes, impellers, or the like, wherein rotation of these components within a housing lifts snow and breaks up from the ground and expel the loose snow and ice through a chute. The chute is often adjustable so that the operator can determine the direction that the snow and ice is expelled and thrown from the snow thrower. During operation, operators often adjust the orientation of the chute in order to expel the snow in different directions so as to throw the snow down-wind, to a particular side of the sidewalk or driveway, or for other reasons. However, rotating or adjusting the direction of snow being thrown from the snow thrower can be difficult and cumbersome, particularly due to added clothing on the operator such as gloves or mittens or due to the components being frozen or simply not meshing easily and efficiently in cold temperatures.

A need therefore exists for a chute control mechanism for a snow thrower that provides for an easily operable operator-movable adjuster combined with components that are easily movable in cold conditions, which allows for an easily adjustable chute.

BRIEF SUMMARY OF THE INVENTION

In one aspect of the present invention, a chute control assembly for a snow thrower is provided, wherein the snow thrower includes a housing, a handle operatively connected to the housing, a pair of wheels operatively connected to the housing, and a chute operatively connected to the housing. The chute control assembly includes a control mechanism attached to the handle, wherein the control mechanism includes a selectively rotatable actuator mechanism. The chute control assembly also includes a guide mechanism attached to the housing and the chute, wherein the guide mechanism rotates the chute relative to said housing in response to rotation of the actuator mechanism. The chute control assembly further includes a connecting mechanism operatively connecting the control mechanism to the guide mechanism, wherein the connecting mechanism transfers rotation of the actuator mechanism to the guide mechanism to cause the chute to rotate relative to the housing. The guide mechanism includes a scalloped surface that provides an indexing engagement between the guide mechanism and the housing.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
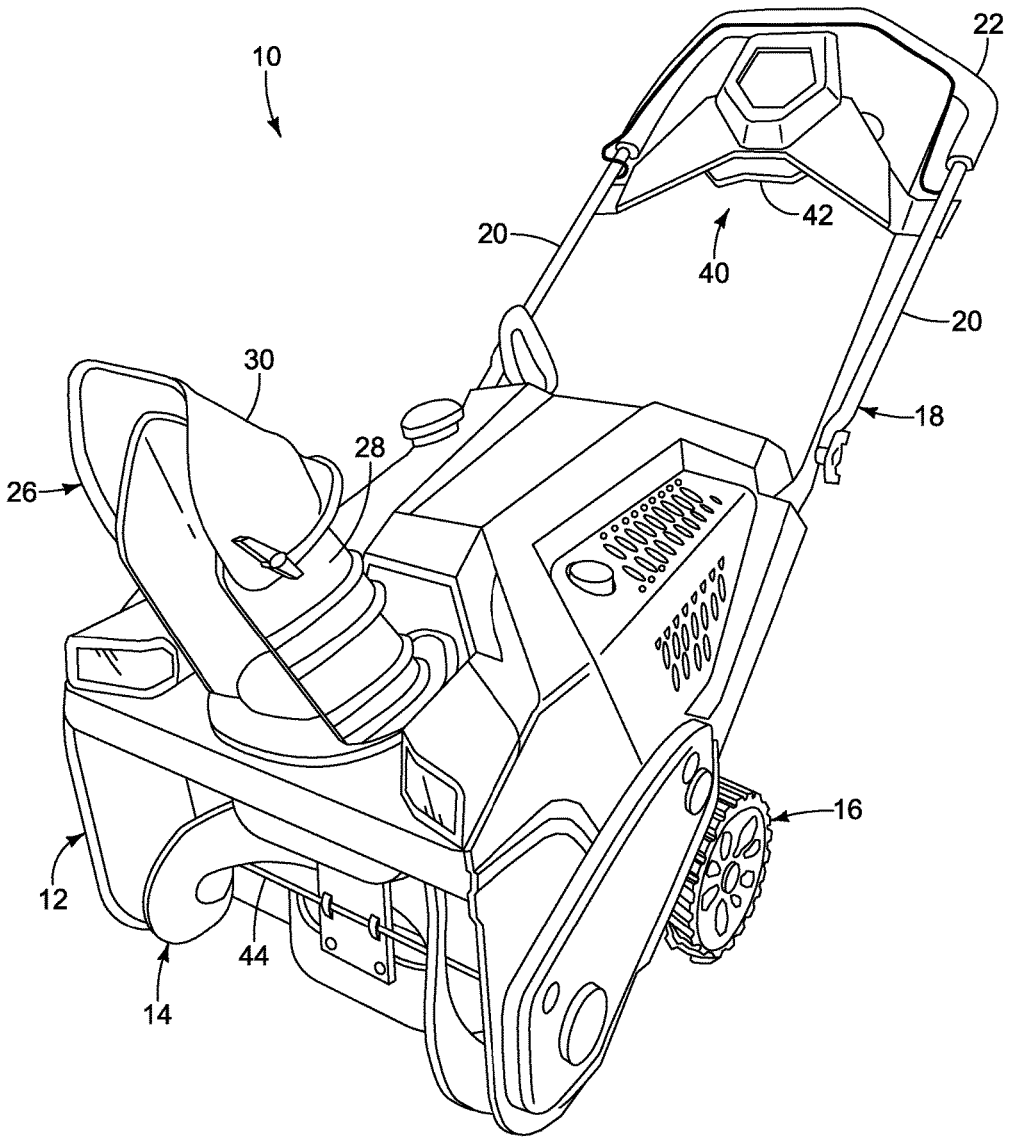
FIG. 1 is a front perspective view of an exemplary embodiment of a snow thrower having a chute control assembly.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Figure 2:
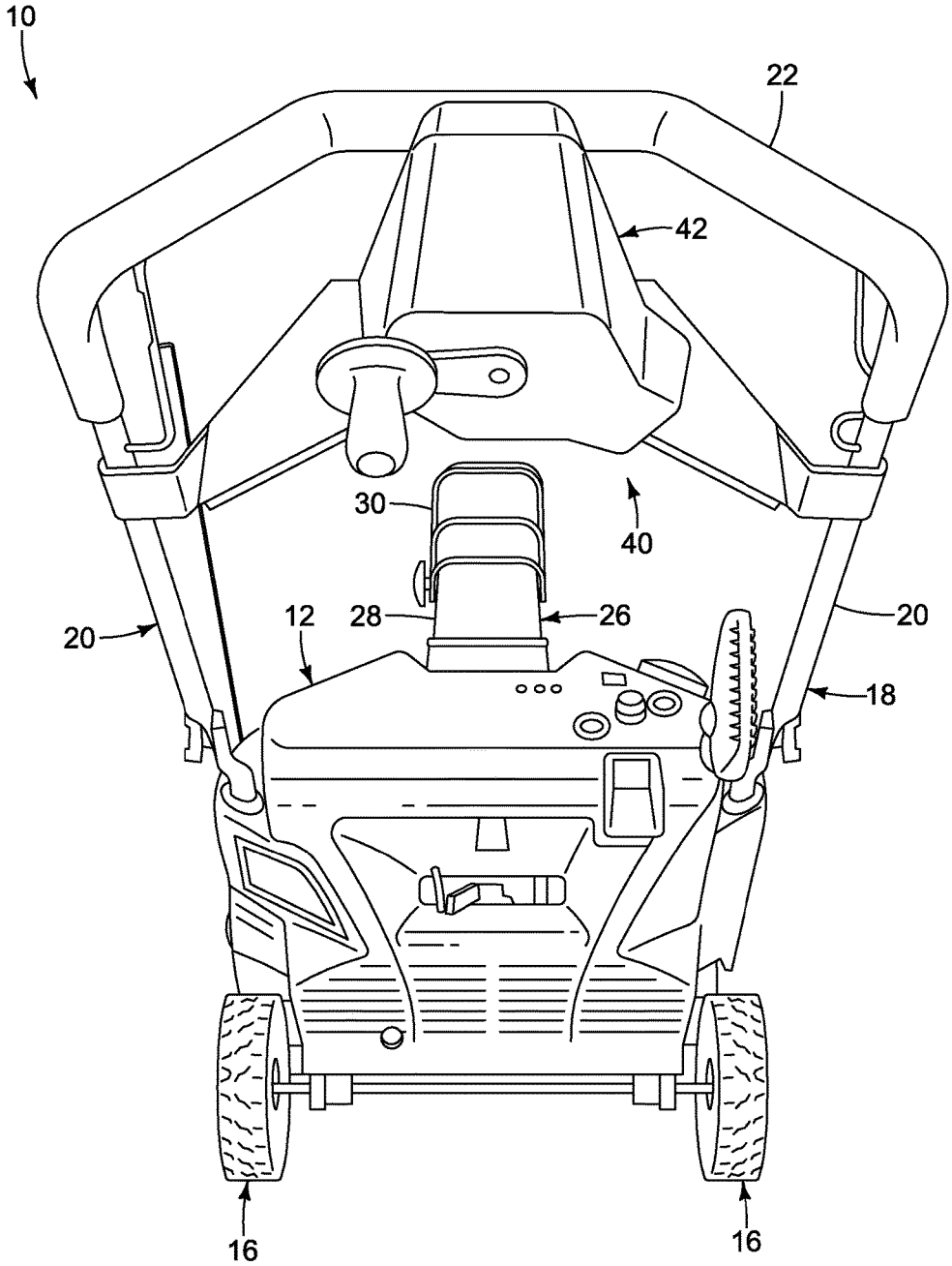
FIG. 2 is a rear perspective view of the snow thrower shown in FIG. 1.

Referring to FIGS. 1-2, an exemplary embodiment of a snow thrower 10 is shown. The snow thrower 10 is configured to remove accumulated snow and ice from surfaces such as sidewalks, driveways, parking lots, and the like. The illustrated snow thrower 10 is a residential snow thrower typically used by homeowners, small business with sidewalks, or the like. Residential snow throwers are often not as powerful as commercial snow throwers, but residential snow throwers are still able to expel snow and ice long distances and at a high rate of speed as it exits the snow thrower. The illustrated embodiment of the snow thrower 10 includes a housing 12 in which at least one auger 14 is rotatably disposed. A pair of wheels 16 are operative connected to the housing 12 to allow the snow thrower to be easily moved along the ground. A handle 18 is also operatively connected to the housing 12 in order to allow an operator to easily steer the snow thrower 10. In the illustrated embodiment, the handle 18 includes a pair of generally parallel and spaced-apart side arms 20 and a cross arm 22 that extends and connects each of the side arms 20. It should be understood by one having ordinary skill in the art that that handle 18 can be formed of any number of members extending from the housing 12 or a frame which allows an operator to control the direction and movement of the snow thrower 10.

In the illustrated embodiment of the snow thrower 10 shown in FIGS. 1-2, a single auger 14 rotates about a substantially horizontal axis is positioned at least partially within the housing 12. The auger 14 is configured to separate accumulated snow and ice from the surface on which the snow thrower 10 traverses, such as a sidewalk, driveway, or the like. The auger 14 then lifts the snow and ice and rotates it within the housing 12 until it is finally directed toward the chute 26 that extends away from the housing 12. The chute 26 is configured to allow the snow to exit the housing 12 as well as direct the snow and ice away from the snow thrower 10. The auger 14 is configured to rotate at a velocity sufficient to cause the snow and ice to travel through the chute 26 at a sufficient speed such that the snow and ice are thrown away from the snow thrower 10. In some embodiments of the snow thrower 10, the rotational velocity of the auger 14 or other final snow-moving component within the housing can be adjustable in order to allow the operator to determine the velocity of the snow and ice as it exits the housing 12. It should be understood by one having ordinary skill in the art that any number of augers 14, brushes, or other rotatable components (such as an impeller) may be positioned at least partially within the housing to rotate in order to lift the snow and/or ice from the surface below.

As shown in FIGS. 1-2, the chute 26 is a generally tubular member that extends upwardly from the housing 12. The illustrated embodiment of the chute 26 includes two U-shaped components rotatably attached together, but it should be understood by one having ordinary skill in the art that the chute can be formed of fully-enclosed tubular member(s) or other cross-sectional-shaped member(s) sufficient to receive and guide the expelled snow and ice away from the snow thrower 10. The chute 26 is configured to be adjustable in order to allow the operator to choose the direction in which the expelled snow is thrown or expelled. The chute 26 can be rotatably adjustable relative to the housing 12 from which it extends or the components of the chute 26 can be rotatable adjustable relative to each other in order to adjust the angle at which the show and ice exit the chute 26.

In the embodiment illustrated in FIGS. 1-2, the chute 26 is formed of a lower member 28 and an upper member 30, wherein the upper member 30 is rotatably attached to the lower member 28 and the lower member 28 is rotatable relative to the housing 12. The lower member 28 is rotatable relative to the housing 12 in order to determine the general direction at which the snow is thrown away from the snow thrower 10. The upper member 30 is rotatable relative to the lower member 28 in order to determine the angle at which the snow exits the chute 26. In an embodiment, the upper member 30 is adjustable by manually grasping the upper member 30 (or a handle extending therefrom) and rotating the upper member 30 so as to change the angle of the upper member 30 relative to the lower member 28. In other embodiments, the upper member 30 can be adjusted relative to the lower member 28 by an adjustment mechanism (not shown). The lower member 28 is rotatable relative to the housing 12 by way of a chute control assembly 40 that is controlled by the operator for adjusting the overall direction of expulsion of the snow and ice from the snow thrower 10.

Figure 3A:
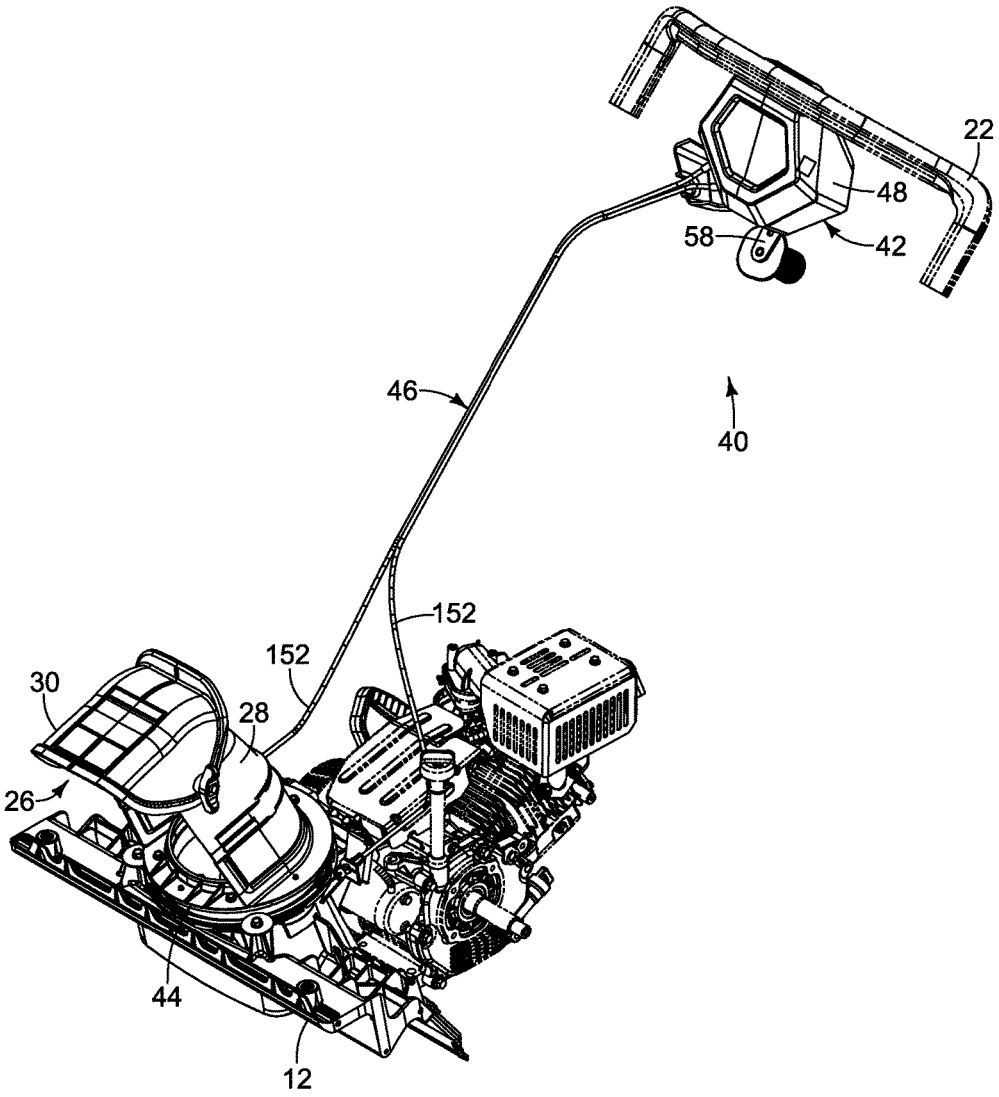
FIG. 3A is a front perspective view of the chute control assembly.
Figure 3B:
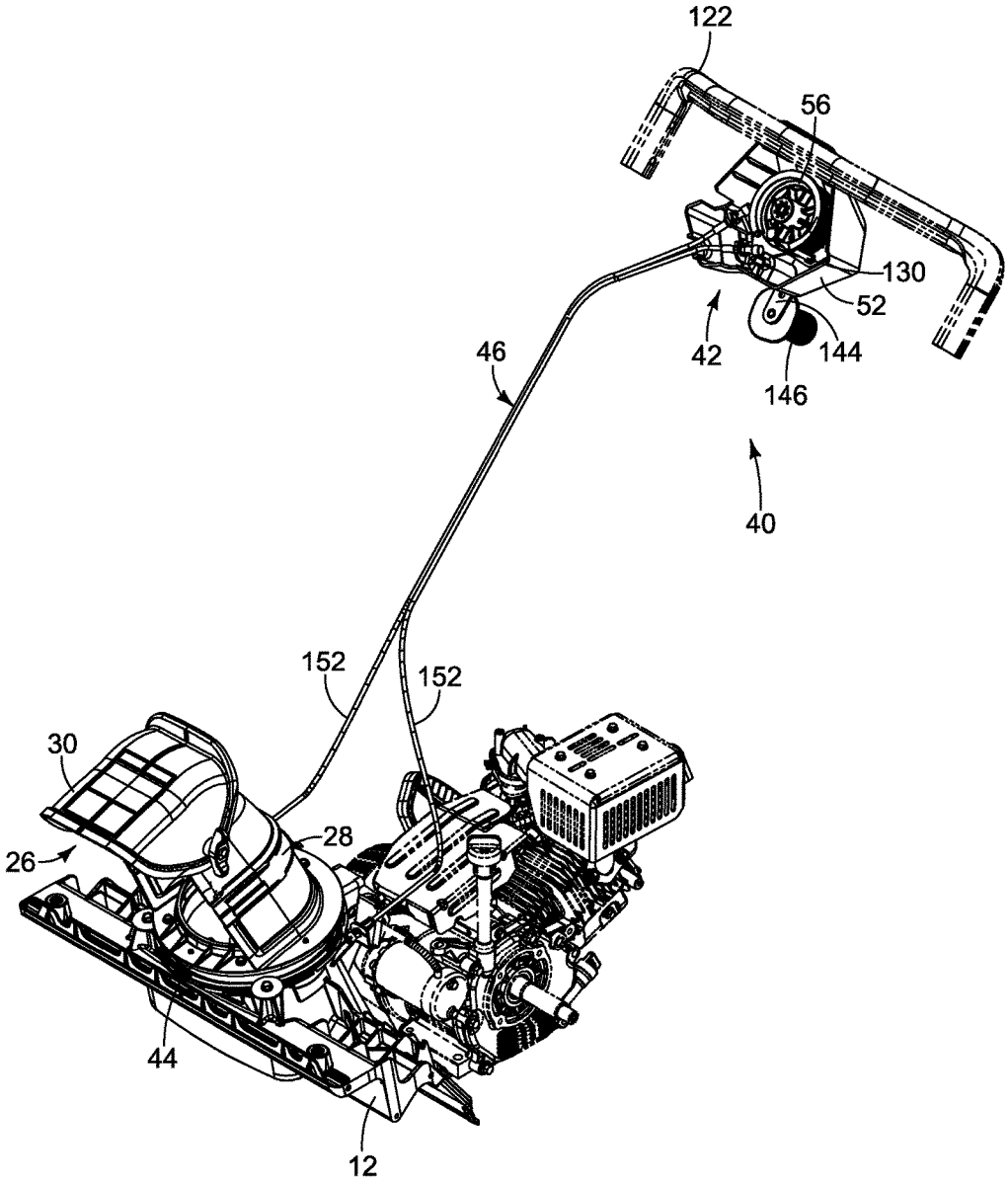
FIG. 3B is a front perspective view of the chute control assembly shown in FIG. 3A with a portion of the casing removed.
Figure 4:
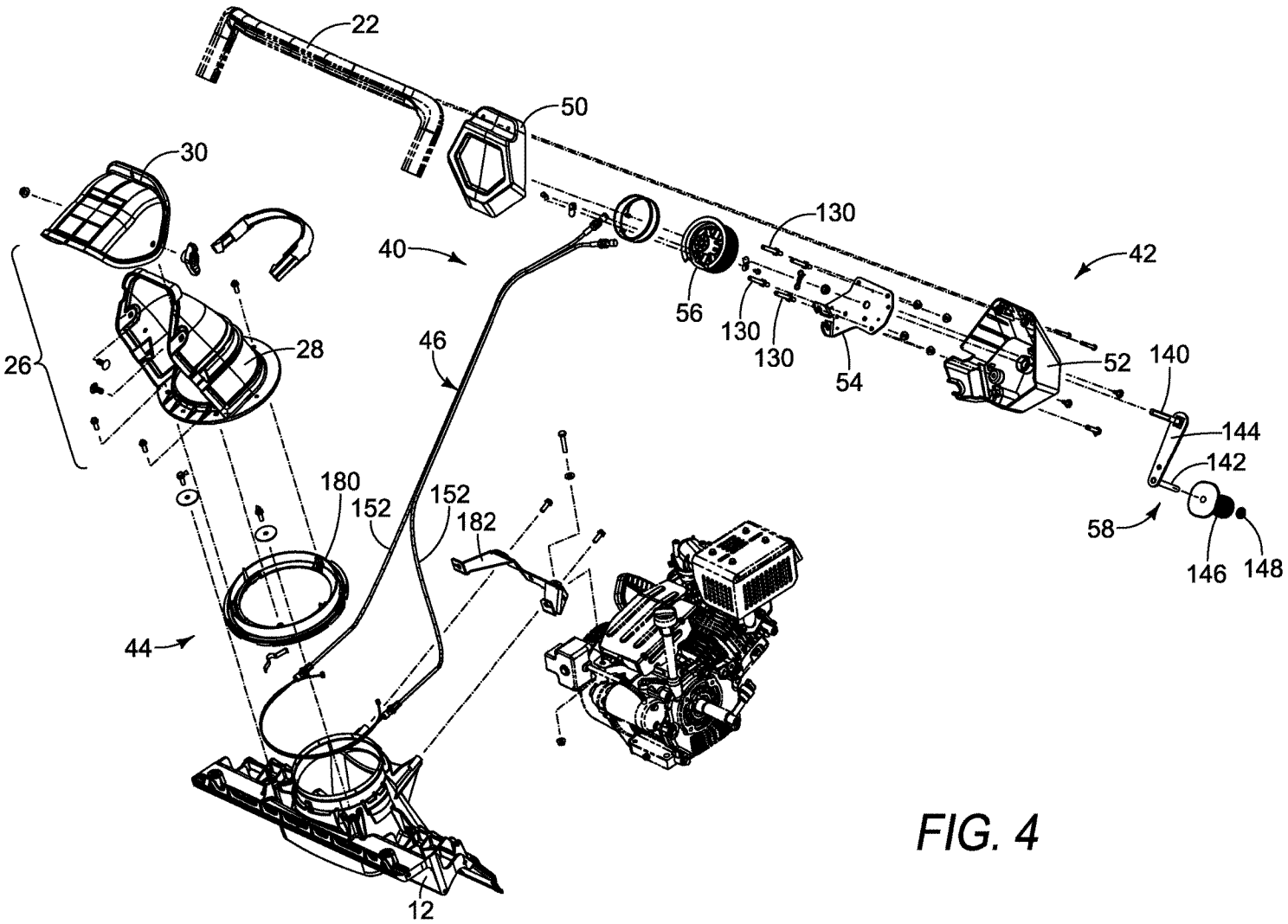
FIG. 4 is an exploded view of an embodiment of the chute control assembly.

In an embodiment, the chute control assembly 40 includes a control mechanism 42 attached to the handle 18, a guide mechanism 44 connecting the housing 12 and the lower member 28 of the chute 26, and a connecting mechanism 46 that operatively connects the control mechanism 42 and the guide mechanism 44, as shown in FIGS. 3A-3B and 4. The control mechanism 42 is configured to be actuated by the operator through rotation of a handle, movement of a lever, or movement of any other component, wherein such rotation or movement results in an output movement that is transferred to the connecting mechanism 46. The connecting mechanism 46 is configured to transfer the actuation of the control mechanism 42 to the guide mechanism 44. The guide mechanism 44 is configured to cause the chute 26 to rotate relative to the housing 12 in the direction and extent as determined by the actuation of the control mechanism 42. The control mechanism 42 of the chute control assembly 40 is positioned within easy reach of the operator's hand(s) during operation of the snow thrower 10 in order to allow the operator to manually adjust or rotate the chute 26 to the desired direction while still being able to control the snow thrower 10. It is not necessary for the operator to cease operation of the snow thrower 10 in order to adjust the orientation of the chute 26 relative to the housing 12.

Figure 5:
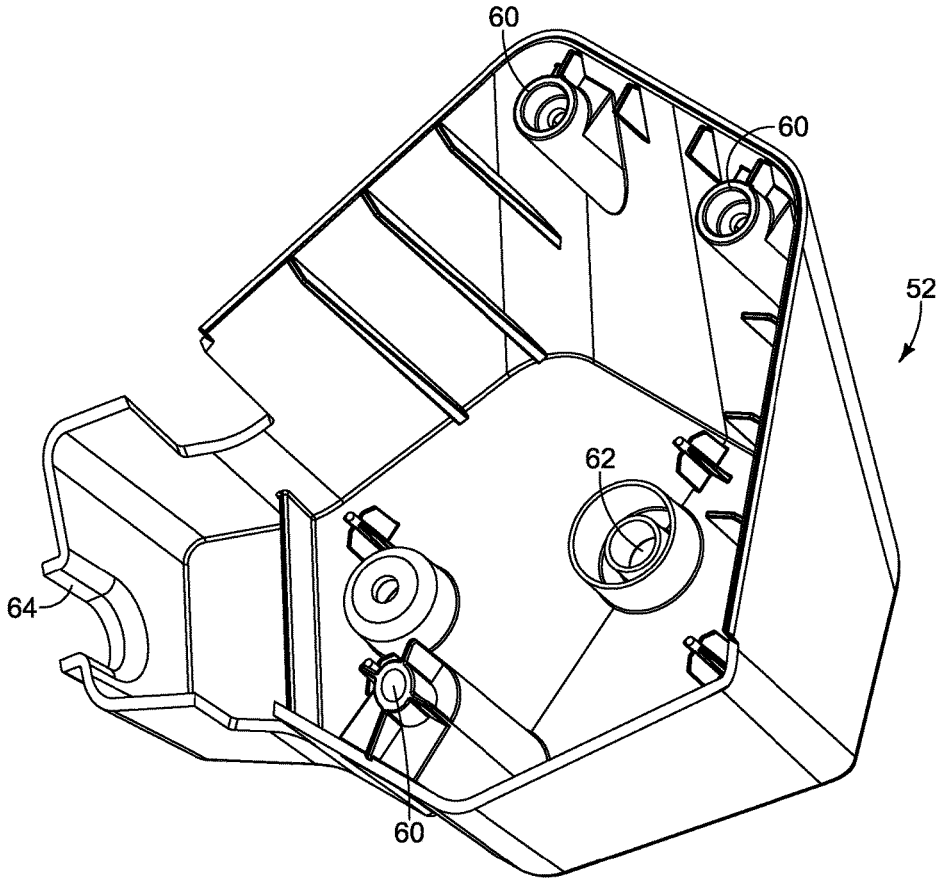
FIG. 5 is an isometric view of an embodiment of a lower casing.

In an embodiment, the control mechanism 42 includes a casing 48 that is attached to both the side arms 20 and the cross arm 22, a mounting plate 54, a spool assembly 56, and an actuator mechanism 58 positioned within or extending from the casing 48, as shown in FIGS. 1-2. In other embodiments, the casing 48 is attached to only the cross arm 22, as shown in FIGS. 3A-3B. In further embodiments, the casing 48 is attached to only one or both of the side arms 20. The casing 48 is configured to house some of the components of the control mechanism 42 therein and provide a base to which other components of the control mechanism 42 are attached. In an embodiment, the casing 48 includes an upper casing 50 removably attachable to a lower casing 52, as shown in FIG. 4. As shown in FIG. 5, the lower casing 52 is a cup-shaped member having a plurality of connecting bosses 60 that allow the lower casing 52 to be releasably attachable to the upper casing 50. The lower casing 52 further includes an aperture 62 formed through the lower wall of the lower casing 52, wherein the aperture 62 is configured to receive the actuator mechanism 58 therein. The lower casing 52 also includes an extension portion, and the extension portion includes a cut-out 64 in the side wall thereof. The cut-out 64 is generally U-shaped and is configured to allow a portion of the connecting mechanism 46 to exit the casing 48.

Figure 6:
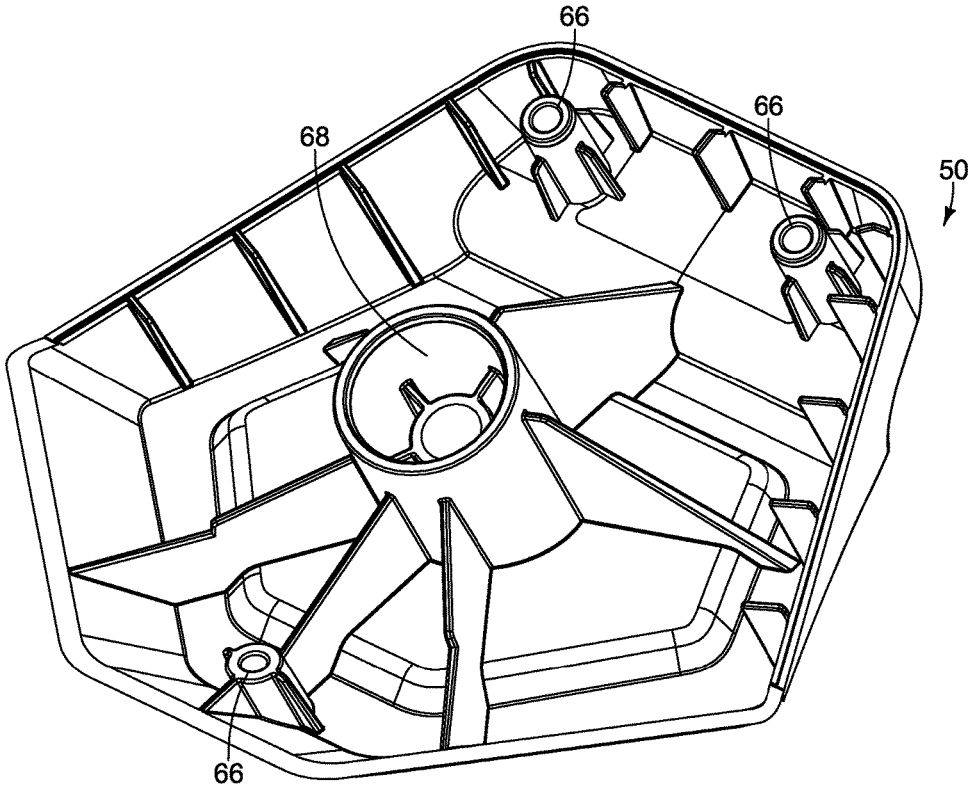
FIG. 6 is an isometric view of an embodiment of an upper casing.

In the illustrated embodiment shown in FIG. 6, the upper casing 50 is an inverted bowl-shaped member that is releasably attachable to the lower casing 52. The upper casing 50 includes a plurality of connecting bosses 66 that are attachable to the corresponding connecting bosses 60 of the lower casing 52 to form the casing 48. The upper casing 50 further includes a securing boss 68 configured to secure the spool assembly 56 within the casing 48, thereby preventing the off-axis tilting of the spool assembly 56 within the casing 48.

Figure 7:
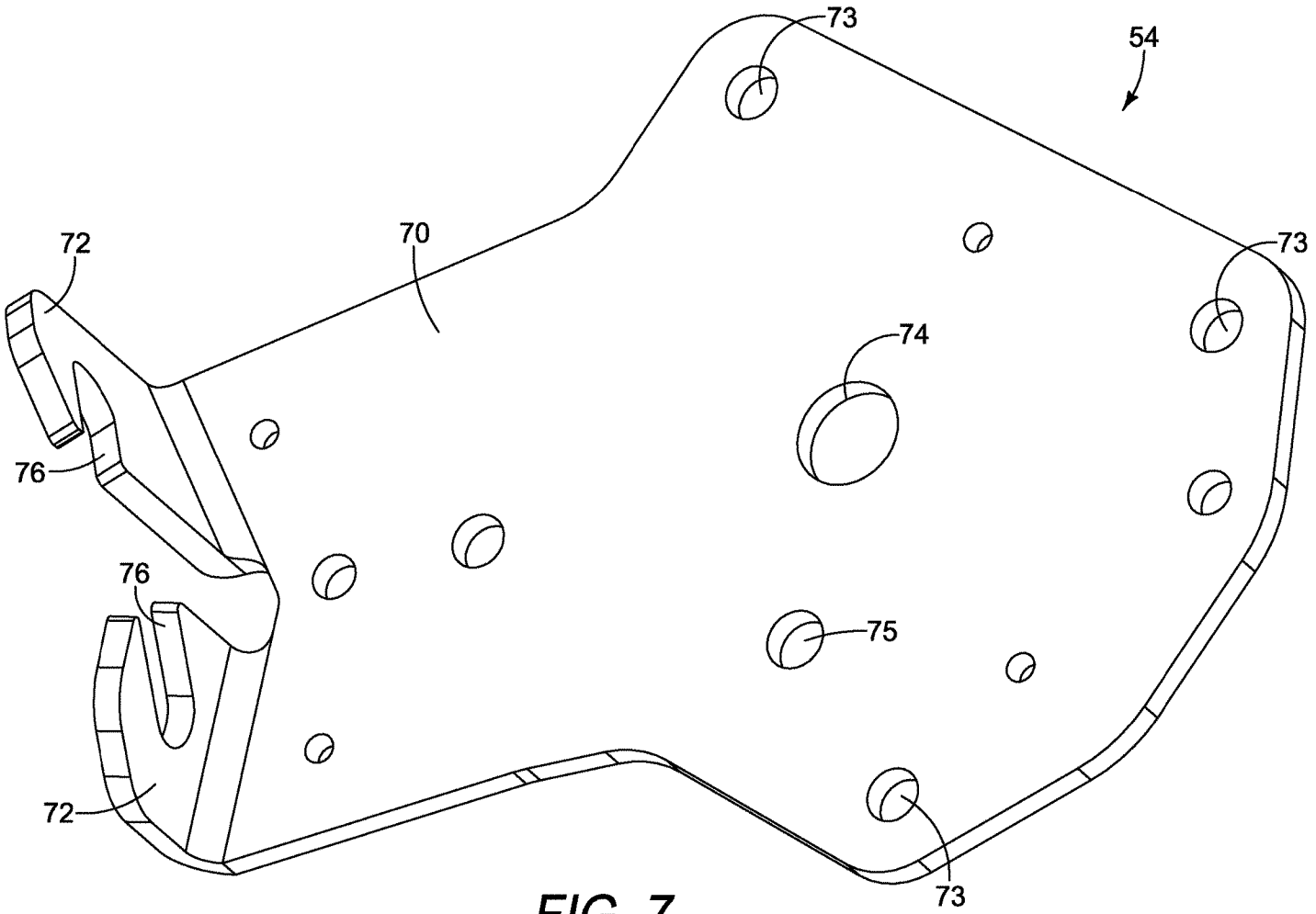
FIG. 7 is an isometric view of an embodiment of a mounting plate.

As shown in FIG. 7, an exemplary embodiment of the mounting plate 54 is shown. The mounting plate 54 is positioned between the upper and lower casings 50, 52, wherein the mounting plate 54 is attached to the lower casing 52. The mounting plate 54 is configured to provide a structural surface within the casing 48 to which a portion of the connecting mechanism 46 is attached. The mounting plate 54 includes a base 70 and a pair of legs 72 that extend at an angle from the base 70. The base 70 is a generally flat member that is sized and shaped to be received within the lower casing 52. The base includes a plurality of attachment apertures 73 formed therethrough, wherein the attachment apertures 73 are configured to receive an attachment mechanism for positively attaching the mounting plate 54 to the lower casing 52. The base 70 includes a receiving aperture 74 centrally located in the base 70, wherein the receiving aperture 74 is configured to allow a portion of the actuator mechanism 58 to pass therethrough. The base 70 also includes an alignment aperture 75 configured to receive an alignment pin (not shown) for aligning the spool assembly 56 within the casing 48, as will be explained in more detail below. In an embodiment, the mounting plate 54 is fixedly attached to the lower casing 52. In another embodiment, the control mechanism 42 does not include the mounting plate 54, wherein the spool assembly 56 is sandwiched directly between the upper and lower casings 50, 52 and is rotationally controlled by the actuator mechanism 58.

Figure 9A:
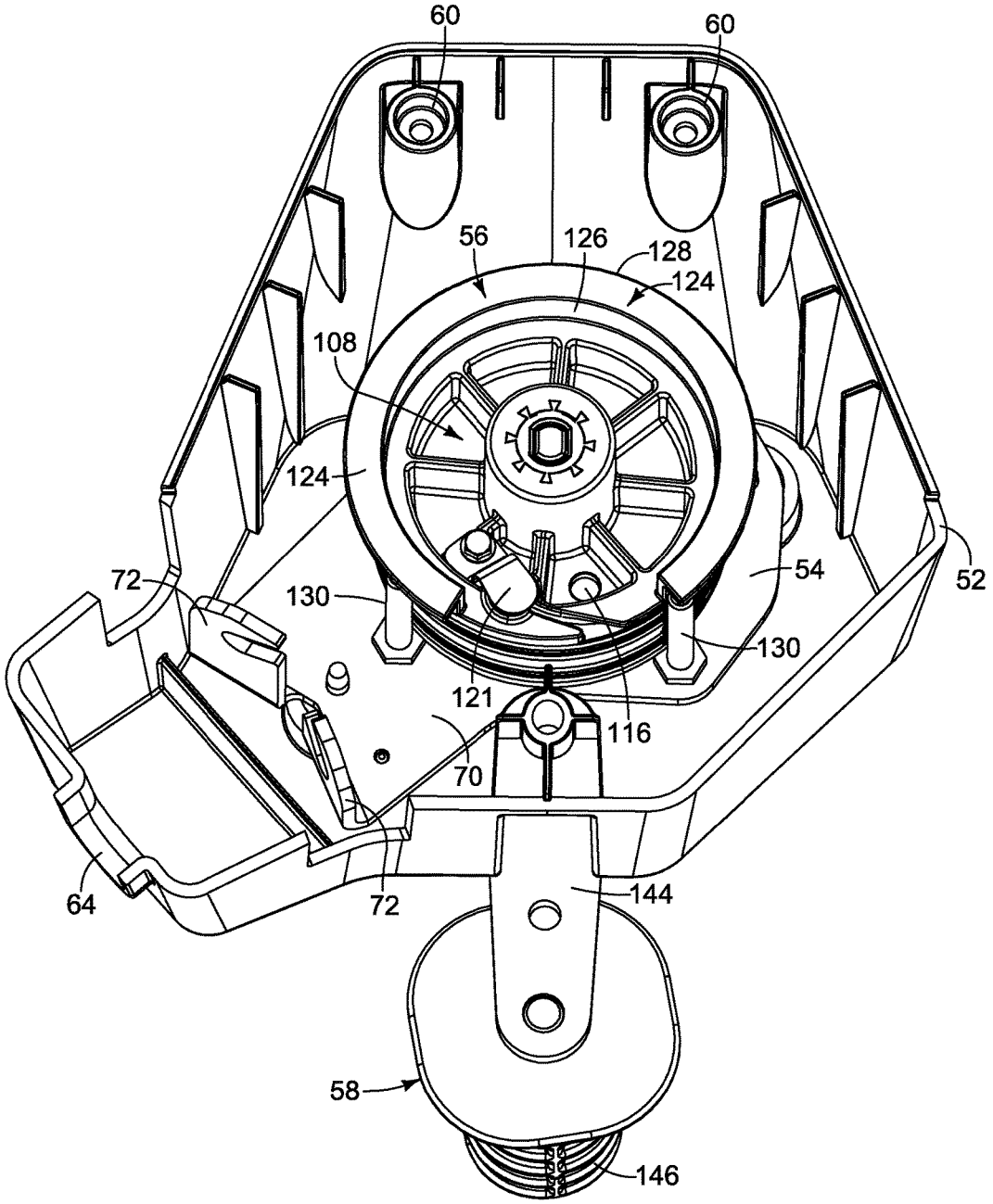
FIG. 9A is a top view of a portion of the control mechanism.
Figure 9B:
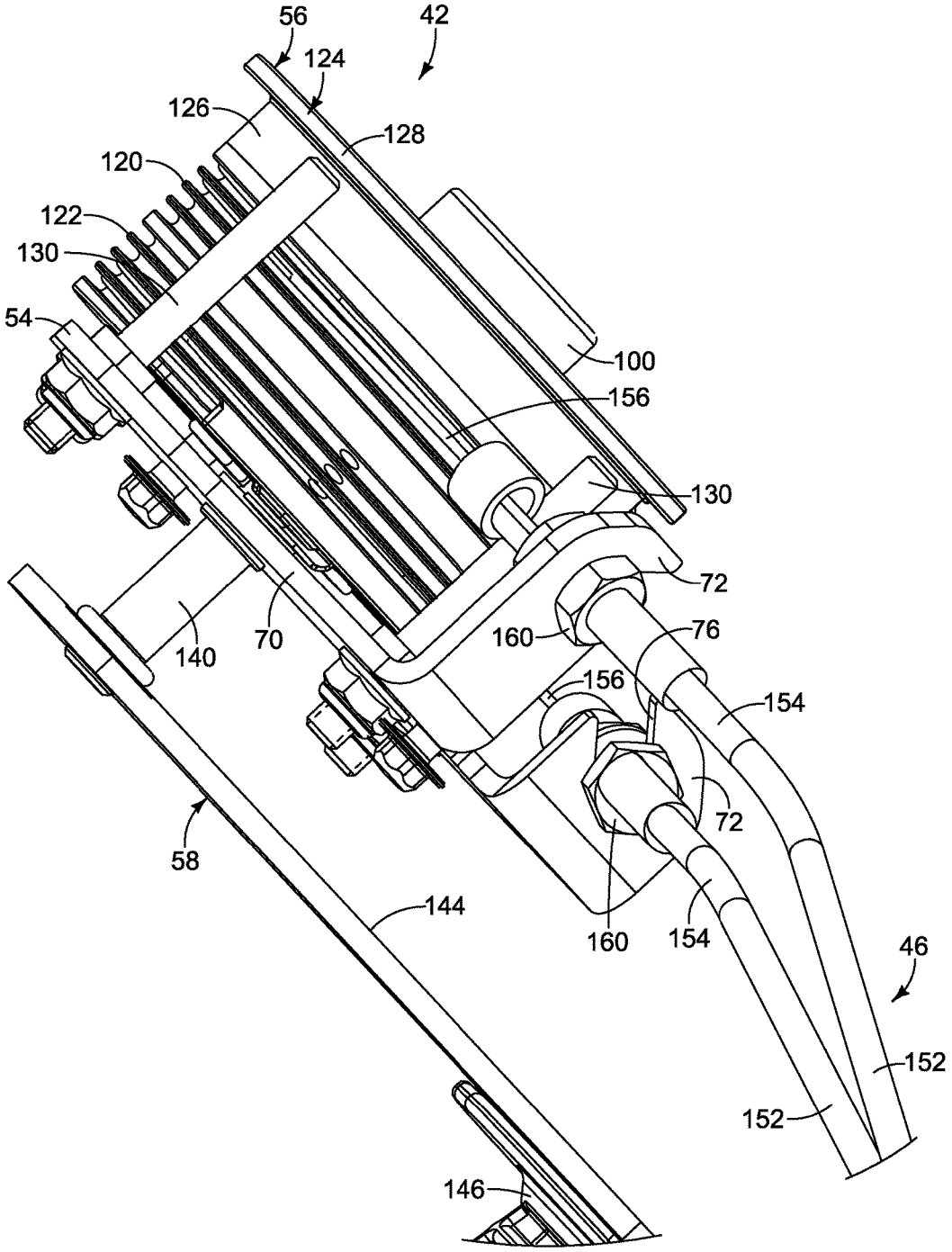
FIG. 9B is a side view of a portion of the control mechanism and a portion of the connecting mechanism.

In an embodiment, the legs 72 of the mounting plate 54 are integrally formed with the base 70 and are bent upwardly at an angle, as shown in FIG. 7. In an embodiment, the legs 72 are aligned substantially perpendicular to the base 70. The legs 72 are positioned adjacent to the extension portion of the lower casing 52. Each leg 72 includes a notch 76 formed therein, wherein in each notch 76 is configured to secure a sheath 154 of a cable assembly 152 thereto, as shown in FIG. 9B. In another embodiment, the legs 72 are formed as a single member, or single leg, extending from the base 70 at an angle and having one or more apertures to which the end of each sheath 154 for a pair of cable assemblies extend. In an embodiment, each notch 76 is configured to retain the barrel adjuster or other outer sleeve component of a Bowden cable.

An exemplary embodiment of the spool assembly 56 is shown in FIGS. 8A-8D. In an embodiment, the spool assembly 56 includes a centrally located cylindrical core 100, wherein the core 100 is formed of a hub 102 and an insert 104. The spool assembly 56 is a generally cylindrical member that is rotatable in both the clockwise and counterclockwise directions within the casing 48 relative to the rotational axis of the core 100. The spool assembly 56 has a first circumferential distance $D_1$, which is measured about the entire circumferential surface of the spool assembly 56. In an embodiment, the hub 102 and insert 104 are formed of different materials, wherein the hub is formed of a plastic material and the insert is formed of a metal material and overmolded into the hub 102. Overmolding the insert 104 into the hub 102 increases the strength and durability of the core 100, wherein a significant amount of torque transfer occurs between the spool assembly 56 and the actuator mechanism 58. In another embodiment, the hub 102 and insert 104 are integrally formed together using the same material for both. The insert 104 includes an aperture 106 that extends the entire axial length thereof. The aperture 106 is configured to receive the actuator mechanism 58 therein. As shown in FIGS. 9A-9B, the upper portion of the core 100 of the spool assembly 56 is received within the securing boss 68 of the upper casing 50 when assembled.

As shown in FIGS. 8A-8D, a central portion 108 extends radially outward from the core 100. In an embodiment, the central portion 108 includes an upper surface 110 and a lower surface 112, wherein the upper surface 110 is directed toward the upper casing 50 and the lower surface 112 is directed toward the lower casing 52 when the spool assembly 56 is positioned within the casing 48. The central portion 108 also includes a plurality of ribs 114 extending radially outward from the core 100. In an embodiment, the central portion 108 includes an alignment aperture 116 formed therethrough. The alignment aperture 116 is configured to be aligned with the corresponding alignment aperture 75 formed through the mounting plate 54. When the pair of alignment apertures 116, 75 are aligned, an alignment pin (not shown) can be inserted through both in order to lock or otherwise restrict rotation of the spool assembly 56 relative to the mounting plate 54 while the connecting mechanism 46 is attached to the guide mechanism 44 and adjustment of the cables of the connecting mechanism 46 are tightened and adjusted.

Figure 8B:
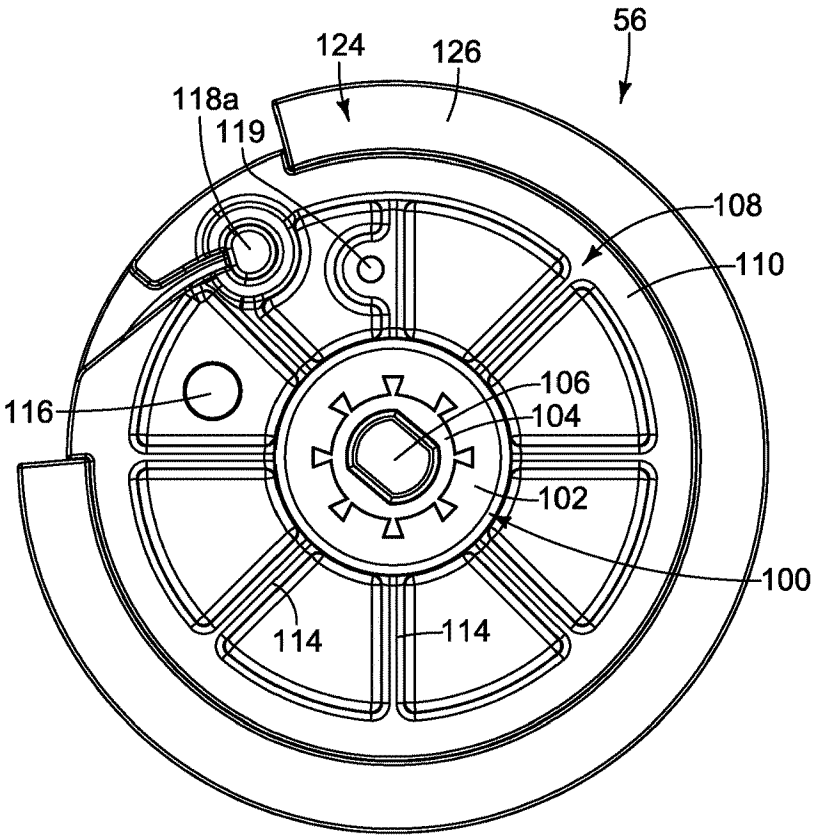
FIG. 8B is a top view of the spool assembly shown in FIG. 8A.

In the illustrated embodiment, an upper securing detent 118*a* is formed into the upper surface 110 of the central portion 108 of the spool assembly 56, as shown in FIG. 8B. The upper securing detent 118*a* is configured to receive an end of a Bowden cable of the connecting mechanism 46, as will be described in more detail below. A lower securing detent 118*b* is formed into the lower surface 112 of the central portion 108. The lower securing detent 118*b* is configured to receive an end of a separate Bowden cable of the connecting mechanism 46. Each securing detent 118*a*, 118*b* includes a groove formed into the corresponding upper/lower surface 110, 112 that extends from the securing detent 118*a*, 118*b* outward along the corresponding surface to the outer peripheral edge of the surface. These grooves aide in guiding the Bowden cable from the securing detent 118*a*, 118*b* over the edge of the surface.

Figure 8A:
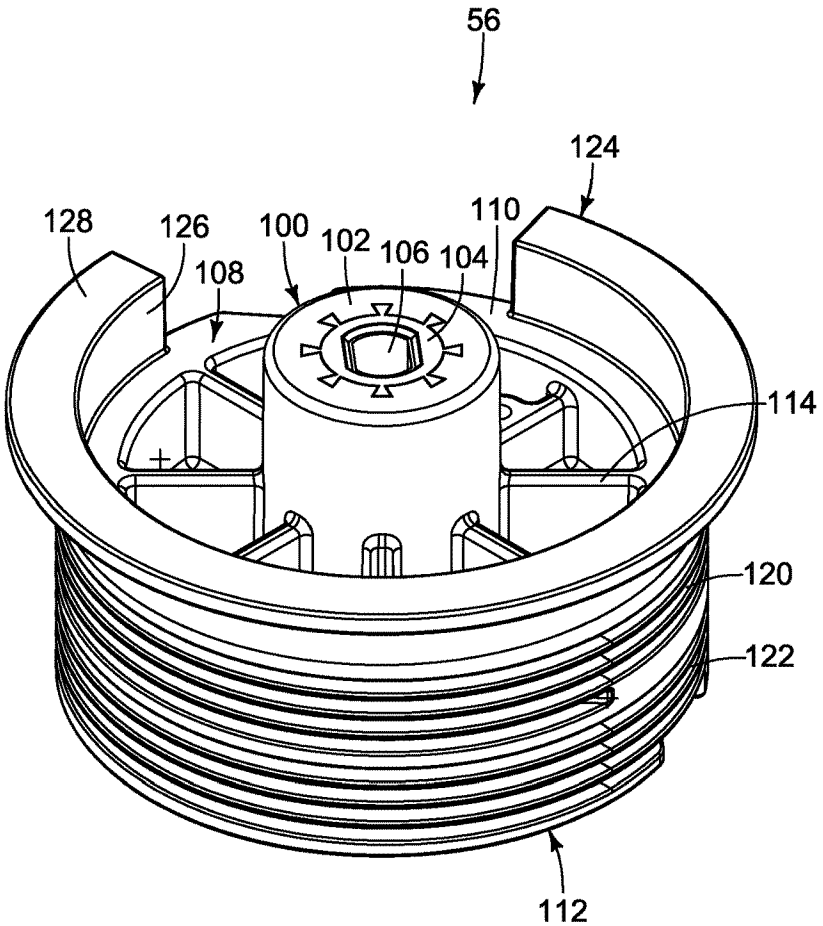
FIG. 8A is an isometric view of an embodiment of a spool assembly.
Figure 8D:
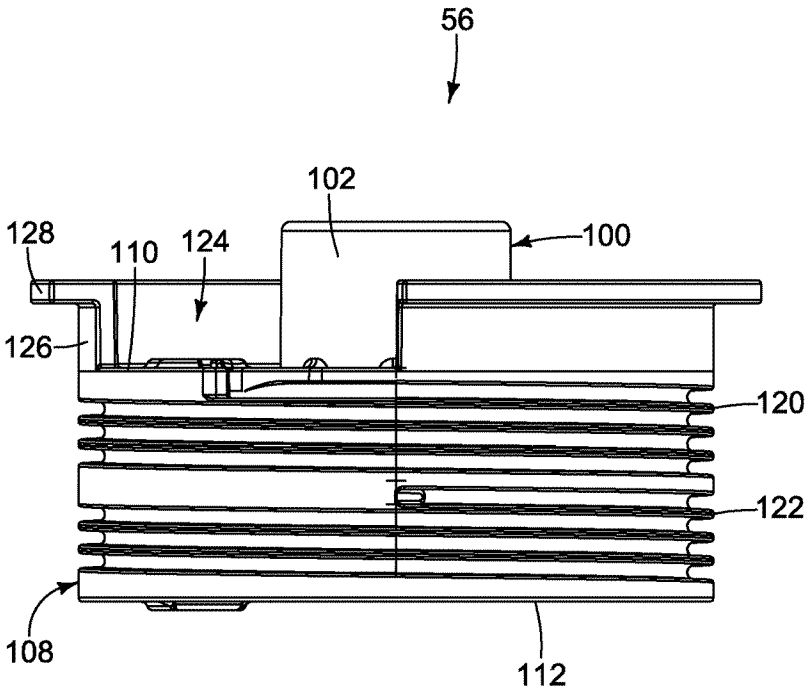
FIG. 8D is a side view of the spool assembly shown in FIG. 8A.
Figure 8C:
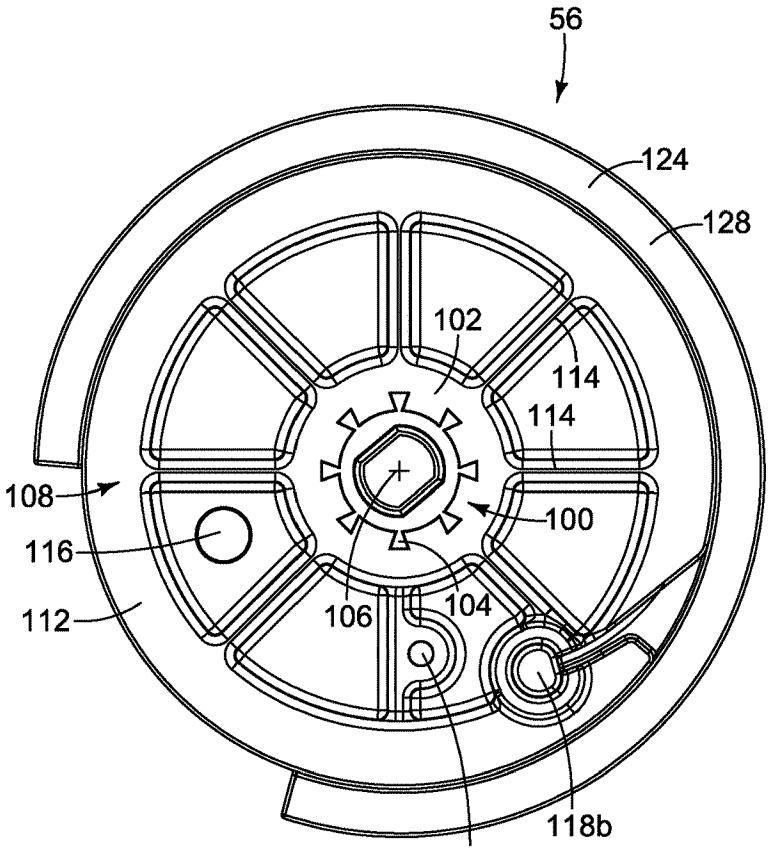
FIG. 8C is a bottom view of the spool assembly shown in FIG. 8A.

The upper and lower surfaces 110, 112 of the central portion 108 of the spool assembly 56 include a detent 119 formed therein, as shown in FIGS. 8B-8C. The detent 119 is configured to receive a cable holder 121 (FIG. 9A) that secures the wire 156 of the connecting mechanism 46 to the corresponding surface of the central portion 108. Each cable holder 121 is a rigid member that is attached to the upper and lower surfaces 110, 112 by way of a screw that is received within the detent 119. The cable holder 121 extends from the detent 119 over the groove that extends from the securing detent 118 in which the wire 156 of a cable assembly 152. The cable holders 121 prevent the corresponding wire 156 of the connecting mechanism 46 from becoming disengaged or displaced relative to the upper or lower surface 110, 112 so as to ensure the cable assembly 152 remains taut.

As shown in FIGS. 8A and 8D, the outer peripheral surface of the central portion 108 of the spool assembly 56 includes an upper helical groove 120 and a lower helical groove 122. Each of the helical grooves 120, 122 rotates about the rotational axis of the spool assembly 56 at least one complete rotation about the outer circumferential surface. In an embodiment, each of the upper and lower helical grooves 120, 122 includes at least one and a half rotations about the outer circumferential surface. In other embodiments, each of the upper and lower helical grooves 120, 122 includes more than two rotations about the outer circumferential surface. The upper and lower helical grooves 120, 122 are each configured to receive a wire 156 (FIG. 12) of a cable assembly 152 of the connecting mechanism 46. The wire 156 of each cable assembly 152 is wound in opposing directions about the outer circumferential surface of the central portion 108, as shown in FIG. 9B.

In an embodiment, the spool assembly 56 includes a positioning ledge 124 extending upwardly from the upper surface 110 of the central portion 108, as shown in FIGS. 8A-8D. In an embodiment, the positioning ledge 124 is integrally formed with the central portion 108. In other embodiments, the positioning ledge 124 is formed separately from the central portion 108 and is fixedly attached thereto during assembly. The positioning ledge 124 includes a first wall 126 that extends axially from the upper surface 110 and a second wall 128 that extends from the first wall 126 in a substantially perpendicular manner. The first wall 126 extends upwardly from the upper surface 110 adjacent to the outer peripheral edge of the upper surface 110 in a substantially perpendicular manner. The first wall 126 extends from the upper surface 110 about only a portion of the circumference of the upper surface. In the embodiment illustrated in FIGS. 8A-8D, the first wall 126 extends continuously circumferentially about the upper surface 110 between about 270°-315°. In another embodiment, the first wall 126 extends circumferentially about the upper surface 110 in two separate sections (not shown), wherein each section is between about 30°-150°. The first wall 126 extends from the upper surface 110 less than the entire circumference thereof so as to allow the cable to extend from the securing detent 118*a*—which is located radially within the first wall 126—over the outer peripheral edge of the upper surface 110.

The second wall 128 of the positioning ledge 124, as shown in FIGS. 8A-8C extend substantially perpendicular from the upper edge of the first wall 126. In the illustrated embodiment, the second wall 128 extends circumferentially the same distance as the first wall 126. In other embodiments, the second wall 128 extends circumferentially a smaller distance than the first wall 126. In further embodiments, the second wall 128 is formed of multiple portions, and each portion of the second wall 128 extends circumferentially a smaller distance than the first wall 126. The second wall 128 extends radially outward from the upper edge of the first wall 126. In an embodiment, the first and second walls 126, 128 are integrally formed together. In other embodiments, the first and second walls 126, 128 are formed separately and are then fixedly attached together during assembly.

The positioning ledge 124 of the spool assembly 56 is configured to ensure proper orientation of the spool assembly 56 within the casing 48 during assembly. In the embodiment shown in FIG. 9A, a pair of locating pins 130 are attached to the mounting plate 54 and extend upwardly therefrom. The locating pins 130 extend upwardly from the mounting plate 54 so as to ensure that the spool assembly 56 is assembled in the proper orientation within the casing 48. During assembly, the locating pins 130 prevent the spool assembly 56 from being disposed within the casing 48 upside-down. When the spool assembly 56 is properly assembled, the positioning ledge 124 extends upwardly and the locating pins 130 are positioned immediately adjacent to the upper and lower helical grooves 120, 122 located on the outer circumferential edge of the spool assembly 56. In this position, the upper distal end of the locating pins 130 are located adjacent to the lower surface of the second wall 128 of the positioning ledge 124. However, if the spool assembly 56 is being assembled upside-down, the second wall 128 of the positioning ledge 124 contacts the upper distal end of the locating pins 130, thereby preventing the spool assembly 56 from being slid onto the actuator mechanism 58. It should be understood by one having ordinary skill in the art that one or more locating pins 130 may be attached to the mounting plate 54 to extend upwardly therefrom to ensure the proper orientation of the spool assembly 56 during assembly. The locating pins 130 also prevent the cables assemblies 152 from unspooling from the upper and lower helical grooves 120, 122 of the spool assembly 56 during assembly. The locating pins 130 are also configured to contain the cable assemblies 152 within the upper and lower helical grooves 120, 122 in case there is any slack occurs in the cable assemblies 152. Because any number of locating pins 130 can extend upwardly from the mounting plate 54, the positioning ledge 124 of spool assembly 56 extends circumferentially about the outer peripheral edge of the upper surface 110 as a single member and over a large portion of the circumference of the spool assembly 56. In embodiments in which only a single locating pin 130 is used, or in embodiments in which a known number of locating pins 130 is always used, the positioning ledge 124 can extend only a short circumferential distance or include multiple separate portions having short circumferential distances.

Figure 10:
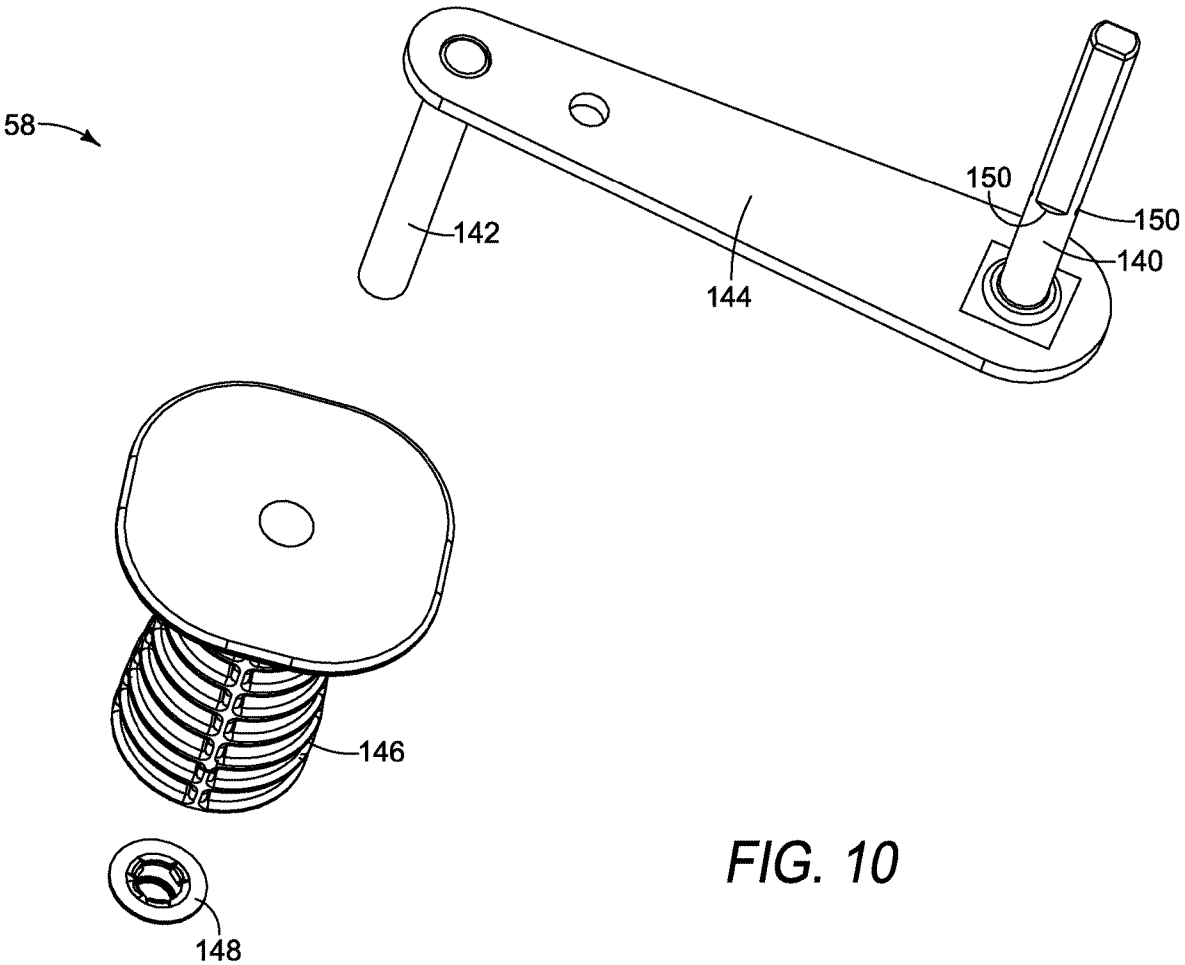
FIG. 10 is an exploded view of an embodiment of an actuator mechanism.

In the illustrated embodiment, the actuator mechanism 58 is formed as a rotatable handle assembly or knob assembly, as shown in FIG. 10, wherein the actuator mechanism 58 is rotatable about a rotational axis in both the clockwise and counter-clockwise directions. The clockwise and counter-clockwise rotation of the actuator mechanism 58 results in corresponding clockwise and counter-clockwise rotation of the chute 26 in order to adjust the direction in which the chute 26 throws snow and ice away from the snow thrower 10. In an embodiment, the actuator mechanism 58 includes a first shaft 140, a second shaft 142, an arm 144, a knob 146, and an attachment mechanism 148. The first shaft 140 is an elongated, generally cylindrical member, wherein a portion of the length of the first shaft 140 is truncated in order to form a double-D shaft. The double-D portion of the first shaft 140 forms a pair of opposing shoulders 150 located at the same axial location along the length of the first shaft 140. The shoulders 150 are configured to abut the lower surface of the insert 104 of the core 100 of the spool assembly 56 when assembled. One distal end of the first shaft 140 is receivable within the core 100 of the spool assembly 56, and the opposing distal end of the first shaft 140 is fixedly attached to the arm 142, as shown in FIGS. 9A-9B. The double-D shaft portion of the first shaft 140 is received within the corresponding double-D aperture formed through the insert 104 of the spool assembly 56. During assembly, once the first shaft 140 is inserted through the aperture 62 in the bottom surface of the lower casing 52, a cotter pin (not shown) is inserted through the first shaft 140 in order to secure the actuator mechanism 58 to the lower casing 52 and prevent the actuator mechanism 58 from falling out of the lower casing 52. After the actuator mechanism 58 is secured to the lower casing 52, the spool assembly 56 is slid onto the first shaft 140 until the core 100 contacts the shoulders 150 of the first shaft 140. The shape of the double-D portion of the first shaft 140 corresponds to the double-D shape of the insert 104, which allows rotation and torque to be transferred from the actuator mechanism 58 to the spool assembly 56.

The arm 144 of the actuator mechanism 58 is a flat, elongated member, as shown in FIG. 10. The arm 144 includes a first distal end having a first aperture and an opposing distal end having a second aperture. The first aperture is configured to receive the first shaft 140, and the second aperture is configured to receive the second shaft 142 therein. The first and second shafts 140, 142 are fixedly attached to the arm 144, wherein the first and second shafts 140, 142 extend from the arm 144 in opposite directions. The first and second apertures are positioned adjacent to the corresponding distal end in order to maximize the torque generated during rotation of the actuator mechanism 58.

The second shaft 142 of the actuator mechanism 58 is a substantially cylindrical shaft that is fixedly attached to the arm 144, as shown in FIG. 10. The knob 146 is rotatably connected to the second shaft 142. The knob 146 includes an aperture configured to receive the second shaft 142, wherein the attachment mechanism 148 is secured to the distal end of the second shaft 142 to prevent the knob 146 from becoming disengaged from the second shaft 142 while still allowing the knob 146 to rotate about the second shaft 142. The actuator mechanism 58 is actuated when the operator grasps and rotates the knob 142. Rotation of the knob 146 causes the entire actuator mechanism 58 to rotate about the longitudinal axis of the first shaft 140, and rotation of the actuator mechanism 58 causes rotation of the spool assembly 56. Such actuation of the actuator mechanism 148 is transferred to the spool assembly 56 and then from the spool assembly 56 to the connecting mechanism 46.

Figure 3C:
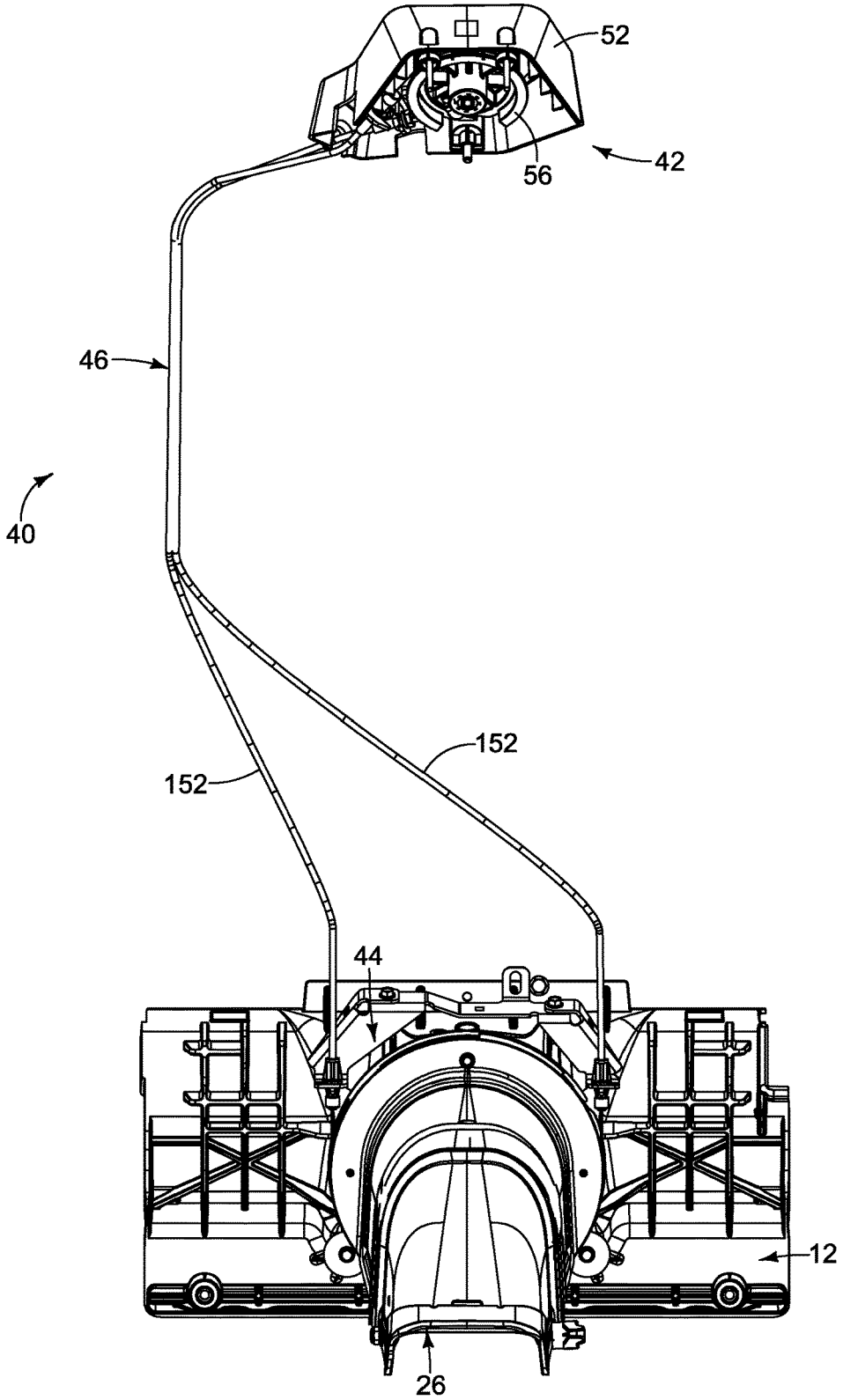
FIG. 3C is a top view of the chute control assembly shown in FIG. 3B.
Figure 11:
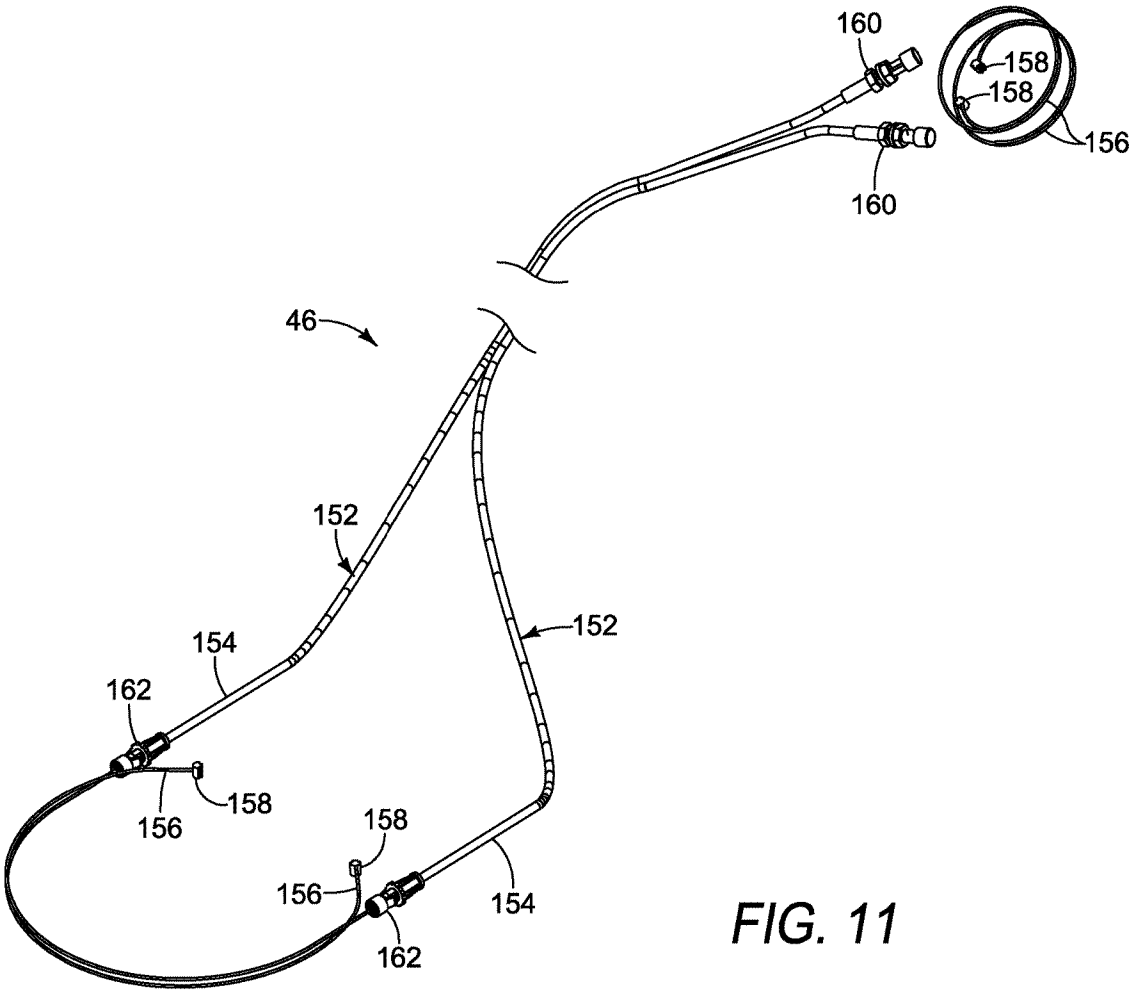
FIG. 11 is an isometric view of an embodiment of a connection mechanism.
Figure 12:
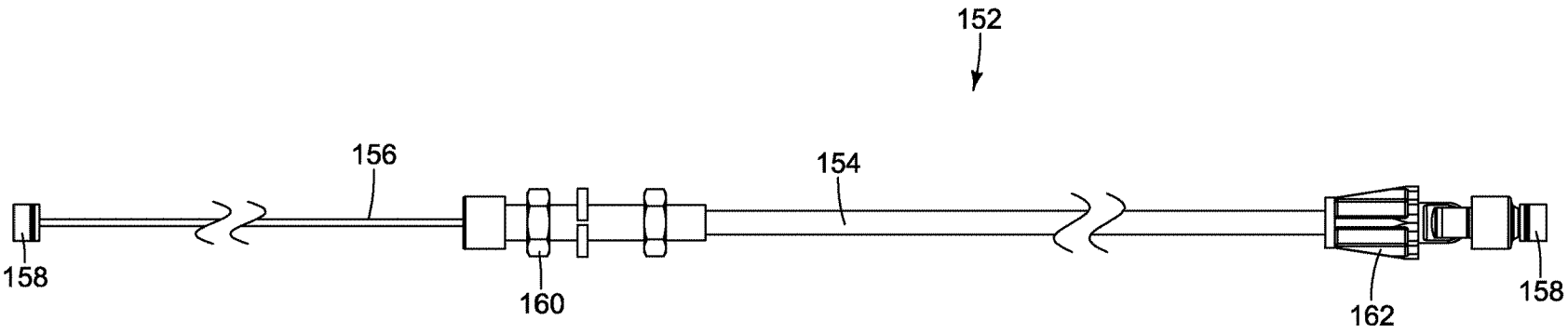
FIG. 12 is an embodiment of a cable assembly.

An exemplary embodiment of the connecting mechanism 46 is shown in FIG. 11. In the illustrated embodiment, the connecting mechanism 46 includes a pair of cable assemblies 152, wherein each cable assembly 152 is operatively connected at one end to the control mechanism 42 and at the opposing end to the guide mechanism 44. In an embodiment, each cable assembly 152 is formed as a Bowden cable, but it should be understood by one having ordinary skill in the art that other types of cables can be used to connect the control mechanism 42 to the guide assembly 44. Each Bowden cable includes one end releasably secured to the spool assembly 56 and an opposing end releasably secured to the chute adapter 180 (FIG. 3C). As shown in FIG. 12, the cable assembly 152 includes a sheath 154, a wire 156, an anchor 158 attached to each distal end of the wire 156, a locking nut 160, and a barrel adjuster 162. In an embodiment, the wire 156 of the cable assembly 152 is a metal wire. It should be understood by one having ordinary skill in the art that the wire 156 can be formed of any material, include a polymeric plastic, a composite material, or any other material sufficient to transfer tensile forces between opposing anchors 158 at each end of the wire 156. A sheath 154 surrounds a portion of the length of the wire 156, wherein a portion of the wire 156 is exposed which allows the wire 156 to slide or otherwise translate within the sheath 154. Each end of the sheath 154 is secured, thereby allowing the wire 156 to move therewithin in response to pulling on one of the anchors 158. In an embodiment, a locking nut 160 is secured to one distal end of the sheath 154 and a barrel adjuster 162 is secured to the opposing distal end of the sheath 154. The locking nut 160 of each cable assembly 152 is attached to one of the legs 72 of the mounting plate 54 to positively attach one end of the sheath to the mounting plate 54. The barrel adjuster 162 is attachable to the mounting bracket 182 of the guide mechanism 44. In other embodiments, the connecting mechanism 46 includes only a pair of wires 156 that connect the control mechanism 42 to the guide mechanism 44, wherein the wires 156 are threaded through eyelets between opposing ends of the wires 156. It should be understood by one having ordinary skill in the art that the cable assemblies 152 can be formed of various different components sufficient to connect the spool assembly 56 to the chute adapter 180 for transmitting rotation of the spool assembly 56 into rotation of the chute adapter 180 in response to actuation of the actuator mechanism 58. In the illustrated embodiment, one end of each of the cable assemblies 152 is directly attached to the spool assembly 56 and the opposing end is directly attached to the chute adapter 180 for a direct transfer of rotation from the spool assembly 56 to the chute adapter 180. Rotation of the spool assembly 56 or the actuator mechanism 58 is directly transferred to the chute adapter 180 by way of the cable assemblies 152.

As shown in FIG. 12, an anchor 158 is fixedly attached to each distal end of the wire 156 of a cable assembly 152. In an embodiment, each anchor 158 is a cylindrical member that extends substantially perpendicular to the longitudinal axis of the wire 156. The wire 156 is connected to each anchor 158 on the outer circumferential surface thereof. For the ends of the cable assemblies 152 connected to legs 72 of the mounting plate 54 of the control mechanism 42, one of the anchors 158 is disposed within the securing detent 118*a* formed into the upper surface 110 of the central portion 108 of the spool assembly 56, and the anchor 158 of the other cable assembly 152 is disposed within the securing detent 118*b* formed into the lower surface 112 of the central portion 108 of the spool assembly 56. Each of the wires 156 extending from an anchor 158 is positioned within a groove formed into the corresponding upper or lower surface 110, 112 of the central portion 108 of the spool assembly 56 until the wire 156 extends over the outer peripheral edge of the central portion 108. The wire 156 extending from the securing detent 118*a* on the upper surface 110 of the central portion 108 is then wound into the upper helical groove 120 before it extends from the spool assembly 56 and is received in a corresponding sheath 154, and the wire 156 extending from the securing detent 118*b* on the lower surface 112 of the central portion 108 is then wound into the lower helical groove 120 before it extends from the spool assembly 56 and is received in a corresponding sheath 154, as shown in FIG. 9B. In the illustrated embodiment, the wires 156 are each wrapped one-and-a-half rotations about the outer circumference of the central portion 108 of the spool assembly 56. It should be understood by one having ordinary skill in the art that the number of rotations about the spool assembly 56 that the wires 156 are wrapped will depend on the circumferential distance of the spool assembly 56, which is directly related to the ratio between the distances of the outer circumferential surfaces of the spool assembly 56 and the chute adapter 180. As such, the wires 156 may be wrapped about the circumference of the central portion 108 of the spool assembly 56 between about one-half of a rotation to about eight rotations.

The opposing end of each cable assembly 152 extends from the control mechanism 42 and is connected to the guide mechanism 44, as shown in FIGS. 3A-3C. In the illustrated embodiment, the guide mechanism 44 includes a chute adapter 180 and a mounting bracket 182, as shown in FIGS. 3C, 4, and 13-14. The mounting bracket 182 is configured to be attached to the housing 12 of the snow thrower 10 and to secure one end of the sheath 154 of each cable assemblies 152 of the connecting mechanism 46. As shown in FIG. 14, the mounting bracket 182 includes a body 184 having a tab 186 extending therefrom. The tab 186 is configured to allow the mounting bracket 182 to be secured to the housing 12 at a location adjacent to the rear of the chute 26, wherein the mounting bracket 182 is located between the chute adapter 180 and the control mechanism 42. The mounting bracket 182 also includes a pair of spaced-apart legs 188 that extend from the body 184. Each leg 188 includes a keyhole notch 190 formed therein. The notches 190 are formed as keyholes, having a small channel that extends from a side edge of the leg 188 toward the center, and the channel connects to a circular hole. Each notch 190 is configured to secure an end of a sheath 154 of a cable assembly 152, thereby allowing the wire 156 to extend beyond the end of the sheath 154 and be attached to the chute adapter 180. The legs 188 extend from the body 184 at different angles so as to guide the end of the wire 156 of the cable assembly 152 toward an attachment location on the chute adapter 180. In an embodiment, the barrel adjuster 162 of each cable assembly 152 releasably secures the sheath 154 to the mounting bracket 182.

Figure 13A:
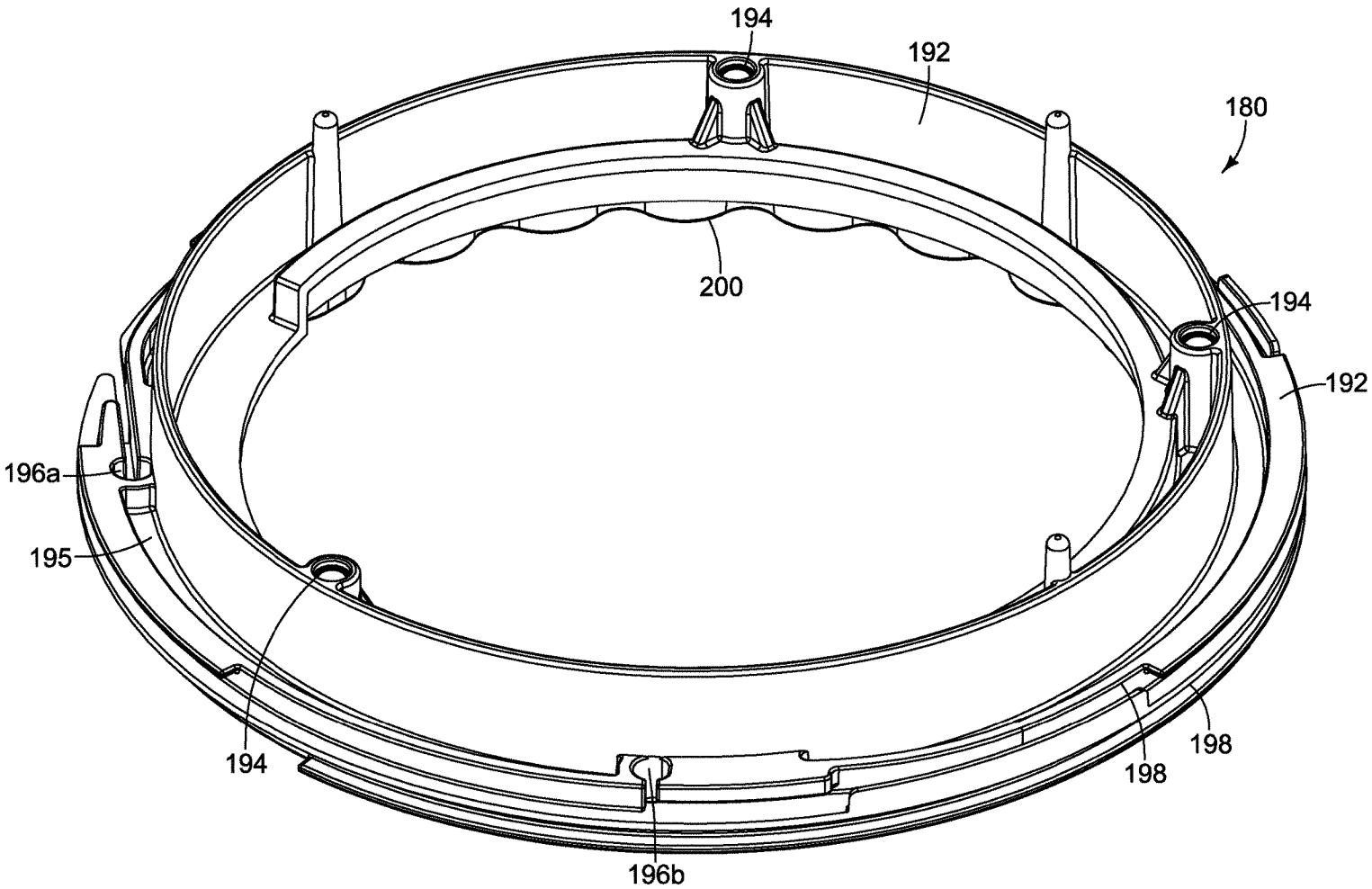
FIG. 13A is an isometric view of an embodiment of a chute adapter.
Figure 13C:
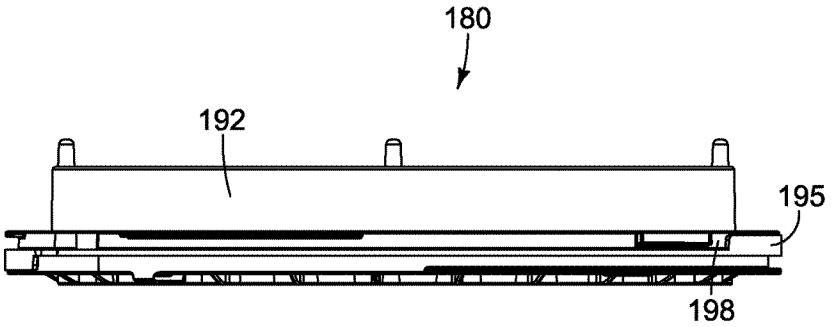
FIG. 13C is a side view of the chute adapter shown in FIG. 13A.
Figure 13B:
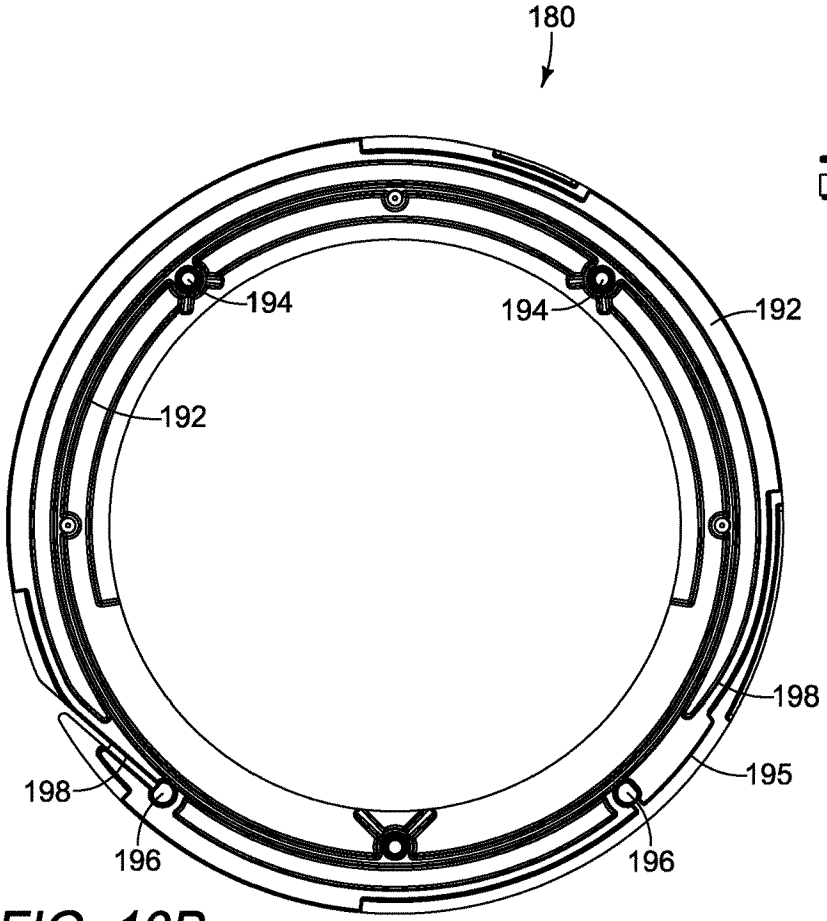
FIG. 13B is a top view of the chute adapter shown in FIG. 13A.
Figure 14:
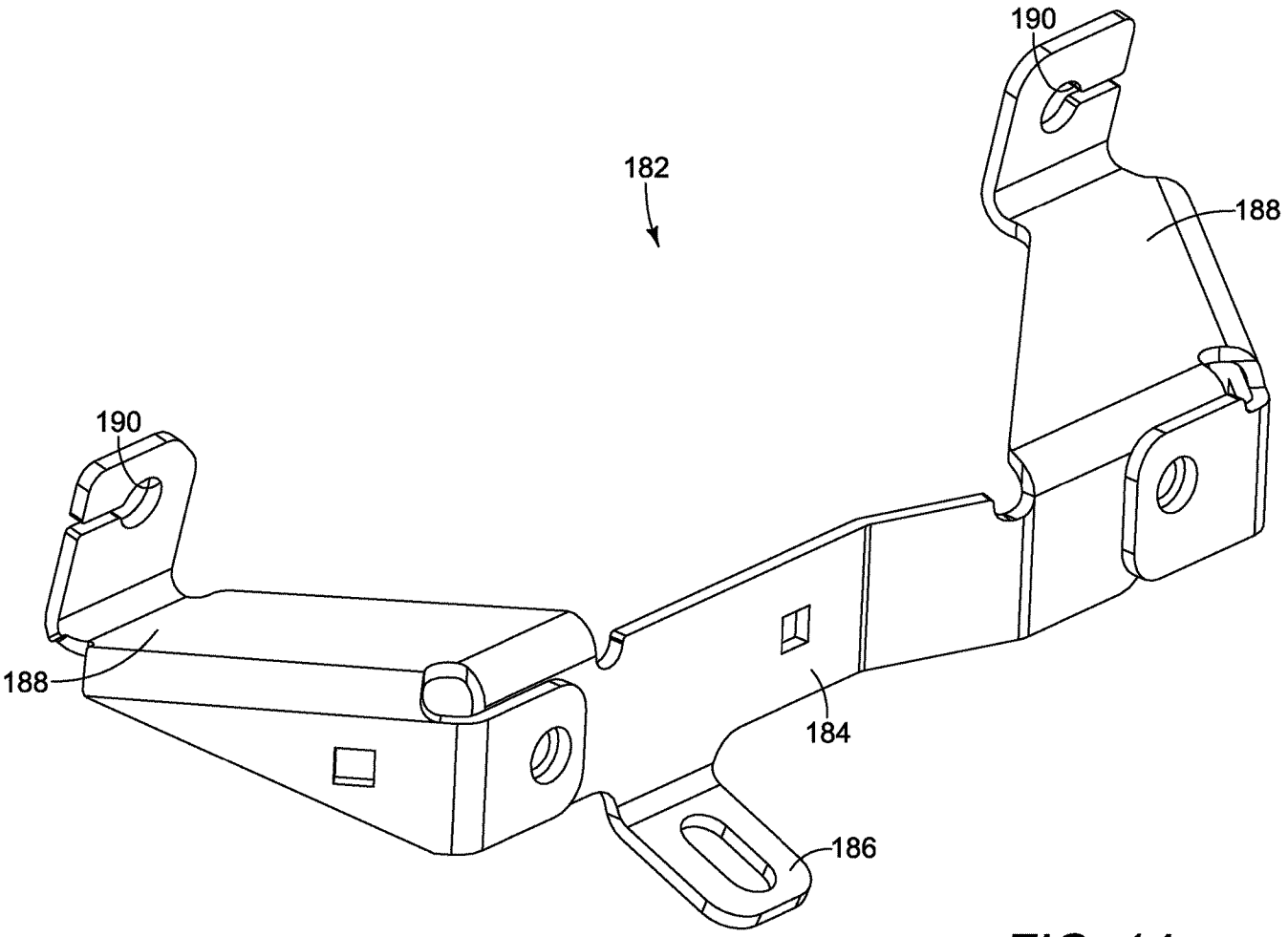
FIG. 14 is an embodiment of a mounting bracket.

FIGS. 13A-13C illustrates an exemplary embodiment of a chute adapter 180 of the guide mechanism 44. The chute adapter 180 is a circular member that is attached to the lower end of the chute 26 and is rotatably connected to the housing 12. The chute adapter 180 includes a circular rim 192 having a plurality of attachment bosses 194 integrally formed with the rim 192, wherein the attachment bosses 194 receive an attachment mechanism for securing the chute adapter 180 to the chute 26. The chute adapter 180 further includes a skirt 195 that extends radially from the outer peripheral surface of the rim 192 and extends about the entire circumference of the rim 192. The chute adapter 180 includes a second circumferential distance $D_2$, which is measured about the entire circumferential surface of the chute adapter 180.

A pair of securing detents 196*a*, 196*b* are formed into the skirt 195 of the chute adapter 180, as shown in FIGS. 13A-13B. Each of the securing detents 196*a*, 196*b* is configured to receive an anchor 158 of one of the cable assemblies 152 of the connecting mechanism 46. The cylindrical anchor 158 of a cable assembly 152 is inserted into a corresponding cylindrical securing detent 196 in the skirt 195. A groove 198 extends from each securing detent 196*a*, 196*b* in a circumferential direction, wherein each groove 198 makes one complete rotation about the outer circumference of the rim 192. The wire 156 of each cable assembly 152 is positioned with one of the grooves 198 such that each wire 156 is wrapped about the rim 192 one complete rotation relative to the axis of rotation of the chute adapter 180. The grooves 198 are oriented such that they wind the wires 156 in opposite directions about rim 192 in the same manner the wires 156 are wound in opposite directions about the central portion 108 of the spool assembly 56. In an embodiment, the ratio of the outer circumferential distance about the rim 192 of the chute adapter 180 relative to the outer circumferential distance about the central portion 108 of the spool assembly 56 is greater than 1:1, wherein the outer circumferential distance about the rim 192 is larger than the outer circumferential distance about the central portion 108. In the illustrated embodiment, the ratio of the outer circumferential distance about the rim 192 of the chute adapter 180 relative to the outer circumferential distance about the central portion 108 of the spool assembly 56 is about 8.65:3.12, but it should be understood by one having ordinary skill in the art that the relative ration can be larger or smaller than this particular ratio. For example, other embodiments may have a ratio between the outer circumferential distance about the rim 192 of the chute adapter 180 relative to the outer circumferential distance about the central portion 108 of the spool assembly 56 being about 4:1, 2:1, 1.5:1, or any other ratio greater than 1:1. Because the spool assembly 56 is rotatable in both the clockwise and counter-clockwise directions from a first operative position, a ratio greater than 1:1 results in the change of angle of rotation of the chute adapter 180 being smaller than the corresponding angle or rotation of the spool assembly 56.

The chute 26 is rotatable about a rotational axis about 90°-100° in both the clockwise and counter-clockwise directions from a first operative position, wherein the first operative position is aligned with the fore/aft longitudinal axis of the snow thrower 10. It should be understood by one having ordinary skill in the art that the length of wire 156 of each cable assembly 152 wound about the circumferential distance of the rim 192 of the chute adapter 180 relative to the central portion 108 of the spool assembly 56 can be any length sufficient to allow the chute 26 to be rotatable between a range of operation. In an embodiment, chute 26 and the chute adapter 180 has an operative range of about 190°, wherein the chute 26 from the first operative position about 95° in the clockwise direction and about 95° in the counter-clockwise direction. The operative range of the chute 26 and chute adapter 180 is the total rotatable range in both directions combined. In other embodiments, the chute 26 and/or chute adapter 180 have an operative range of about 360°. In further embodiments, the chute 26 and/or chute adapter 180 have an operative range less than 360°. In other embodiments, the It should be understood by one skilled in the art that the length of the cable assemblies 152 wound about the chute adapter 180 and the spool assembly 56 determine the range of rotation of the chute 26/chute adapter 180 and the spool assembly 56. The small circumference of the spool assembly 56 relative to the chute adapter 180 provides a more fine-tuned adjustment of the chute 26 in response to rotation of the spool assembly 56. In the illustrated embodiment, the chute adapter 180 has operative range of about 190°, but it should be understood by one having ordinary skill in the art that the components of the chute control assembly 40 can be configured to allow the chute 26 to be rotatable between zero and any angle less than one hundred eighty degrees (180°) in either the clockwise or counter-clockwise direction, wherein the operative range of the chute adapter 180 prevents the chute 26 from discharging snow directly at the operator. In some embodiments, the guide mechanism 44 includes at least one rotational limiter (not shown) which would prevent an operator from rotating the chute 26 to an orientation that would cause the snow and ice to be directed straight at the operator.

The chute adapter 180 further includes a scalloped edge 200 extending downwardly from the rim 192, as shown in FIG. 13A. The scalloped edge 200 engages a leaf spring (not shown) attached to the housing 12, wherein the frictional engagement between the scalloped edge 200 and the leaf spring provides rotational resistance during operation of the chute control assembly 40. The engagement between the scalloped edge 200 and the leaf spring also provides an indexing engagement between the chute adapter 180 and the housing 12.

When the chute control assembly 40 is assembled, the lower casing 52 is attached to the handle 18, and the mounting plate 54 is attached to the interior of the lower casing 52. The actuator mechanism 58 is releasably connected to the spool assembly 56 by inserting the first shaft 140 of the actuator mechanism 58 into the core 100 of the spool assembly 56. The sheath 154 of each cable assembly 152 is attached to one of the legs 72 of the mounting plate 54, and each wire 156 is wound onto the upper and lower helical grooves 120, 122. The anchor 158 of each cable assembly 152 is positioned within a corresponding securing detent 118*a*, 118*b* of the spool assembly 56. Each opposing end of the sheath 154 of both cable assemblies 152 is secured to the legs 188 of the mounting bracket 182. Each wire 156 is positioned in one of the grooves 198 formed into the skirt 195 of the chute adapter 180 and wound about the outer circumference of the rim 192. The free anchor 158 of each cable assembly 152 is then inserted into a securing detent 196*a*, 196*b* of the skirt 195.

In operation, an operator grasps and rotates the actuator mechanism 58 in either the clockwise or counter-clockwise direction. Rotation of the actuator mechanism 58 causes corresponding rotation of the spool assembly 56 in the same direction. As the spool assembly rotates 56, a first wire 156 wound about the spool assembly in the direction opposite the rotation of the spool assembly 56 is pulled in tension, and the tension force is transferred through the corresponding cable assembly 152 to the chute adapter 180. This tension force in the first wire 156 effectively pulls the first wire 156 toward the control mechanism 42 while simultaneously pushing the second wire 152 away from the control mechanism 42. The first wire 156 in tension is wound about the chute adapter 180 such that the tension generated by actuating the control mechanism 42 causes the chute adapter 180 to rotate in the same direction as the direction the operator rotates the actuator mechanism 58. This rotation of the chute adapter 180 also causes the second wire 156 to be pulled toward the guide mechanism 54 in tension through the attachment of the second wire 156 to the chute adapter 180. The tension force generated by pulling on the second wire 156 toward the guide mechanism 54 is transferred to the opposing end of the wire 156 attached to the spool assembly 56 in order to counteract the pushing effect resulting from the rotation of the spool assembly 56. In short, rotation of the actuator mechanism 58 in the clockwise direction results in the clockwise rotation of the chute adapter 180 and the chute 26, and rotation of the actuator mechanism 58 in the counter-clockwise direction results in the counter-clockwise rotation of the chute adapter 180 and the chute 26.

During assembly of the chute control assembly 40, once the cable assemblies 152 are secured to the spool assembly 56 and the chute adapter 180, the spool assembly 56 is rotated such that the alignment aperture 116 of the spool assembly 56 is aligned with the corresponding alignment aperture 75 of the mounting plate 54. An alignment pin (not shown) is insertable through both of the alignment apertures 75, 116 in order ensure proper alignment. When the spool assembly 56 is properly aligned, the arm 144 of the actuator mechanism 58 is located at a first operative position. In an embodiment, the first operative position of the arm 144 is directed forwardly toward the operator making it easier for the operator to grasp the actuator mechanism 58 when the knob 146 is located closest to the operator. After aligning the alignment apertures 75, 116, the cable assemblies 152 are adjusted such that the chute 26 is directed straight ahead when the arm 144 is in the first operative position. As a result, the chute control assembly 40 is arranged such that when the arm 144 is located in the first operative position—or a start position—the chute 26 is also located in a first operative position—or directed straight ahead. In the illustrated embodiment, the arm 144 of the actuator mechanism 58 is alignable with the chute 26, wherein both the arm 144 and the chute 26 have a first operative position and the chute 26 is rotatable in response to rotation of the actuator mechanism 58.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A chute control assembly for a snow thrower, said snow thrower having a housing, a handle operatively connected to said housing, a pair of wheels operatively connected to said housing, and a chute operatively connected to said housing, said chute control comprising:

a control mechanism attached to said handle, said control mechanism includes a rotatable spool assembly positioned within a casing and a selectively rotatable actuator mechanism attached to said spool assembly, said spool assembly has a first circumferential distance;

a guide mechanism, wherein said guide mechanism includes a chute adapter rotatably connecting said chute to said housing, said chute adapter having a second circumferential distance; and a connecting mechanism includes a pair of cables, wherein one end of each cable is connected to said control mechanism and another end is connected to said guide mechanism, wherein said connecting mechanism transfers rotation of said actuator mechanism to said guide mechanism to cause said chute to rotate relative to said housing;

wherein said first circumferential distance is smaller than said second circumferential distance, and wherein a ratio of said second circumferential distance relative to said first circumferential distance is about 8.5:3.

2. The chute control assembly of claim 1, wherein said connecting mechanism includes a pair of Bowden cables extending between said spool assembly and said chute adapter.

3. The chute control assembly of claim 2, wherein one end of each Bowden cable is directly attached to said spool assembly and an opposing end of each Bowden cable is directly attached to said chute adapter.

4. The chute control assembly of claim 1, wherein said connecting mechanism includes a pair of Bowden cables, and one end of each Bowden cable is releasably secured to said spool assembly and an opposing end of each Bowden cable is releasably secured to said chute adapter, wherein rotation of said spool assembly causes rotation of said chute adapter.

5. The chute control assembly of claim 1, wherein said connecting mechanism includes a pair of Bowden cables, and one end of each Bowden cable is directly attached to said spool assembly and an opposing end of each Bowden cable is directly attached to said chute adapter, wherein rotation of said spool assembly is directly transferred to said chute adapter.

6. The chute control assembly of claim 1, wherein said chute is rotatable in both a clockwise direction and a counter-clockwise direction relative to a first operative position of said chute.

7. The chute control assembly of claim 6, wherein said first operative position of said chute is oriented straight ahead.

8. The chute control assembly of claim 6, wherein said chute has an operative range of about one hundred ninety degrees)(190°).

* * * * *